US012140142B2

(12) United States Patent
Cargill

(10) Patent No.: US 12,140,142 B2
(45) Date of Patent: Nov. 12, 2024

(54) ROTARY POSITIVE DISPLACEMENT PUMP

(71) Applicant: ALFA LAVAL CORPORATE AB, Lund (SE)

(72) Inventor: Simon Cargill, Eastbourne (GB)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 18/260,531

(22) PCT Filed: Jan. 19, 2022

(86) PCT No.: PCT/EP2022/051070
§ 371 (c)(1),
(2) Date: Jul. 6, 2023

(87) PCT Pub. No.: WO2022/157167
PCT Pub. Date: Jul. 28, 2022

(65) Prior Publication Data

US 2024/0052834 A1 Feb. 15, 2024

(30) Foreign Application Priority Data

Jan. 19, 2021 (EP) ..... 21152412

(51) Int. Cl.
*F04C 2/12* (2006.01)
*F04C 11/00* (2006.01)
(Continued)

(52) U.S. Cl.
CPC ..... *F04C 15/0096* (2013.01); *F04C 2/126* (2013.01); *F04C 11/001* (2013.01);
(Continued)

(58) Field of Classification Search
CPC .. F04C 2/086; F04C 2/12; F04C 2/126; F04C 13/002; F04C 15/0034; F04C 15/0096;
(Continued)

(56) References Cited

U.S. PATENT DOCUMENTS 8,579,601 B2 11/2013 Kim
8,821,141 B2 9/2014 Helgeson et al.
2003/0152474 A1 8/2003 Luigi

FOREIGN PATENT DOCUMENTS

DE 102012104736 A1 12/2013
EP 0444941 A1 9/1991
(Continued)

OTHER PUBLICATIONS

JP2002-115682-A—Morita et al.—Cooling Structure in Vacuum Pump—Apr. 19, 2002—the English Machine Translation. (Year: 2002).*

(Continued)

*Primary Examiner* — Theresa Trieu
(74) *Attorney, Agent, or Firm* — Buchanan Ingersoll & Rooney PC

(57) ABSTRACT

A rotary positive displacement pump comprises a housing rotationally supporting first and second parallel and axially extending drive shafts having constantly meshing gears such that the drive shafts rotate in opposite directions. A rotor casing is connected to a front side of the housing and has axial rear and front walls and a circumferential side wall jointly defining a pumping cavity. The casing houses first and second rotors drivingly connected to the first and second drive shafts respectively. The rotors rotate in opposite directions and mutually interact to provide a positive pumping effect on fluid product entering the cavity. First and second sealing arrangements prevent leakage of fluid product from the cavity towards the rear side of the casing along the first/second drive shafts. A heating device is detachably fastened to the rear casing wall to heat the casing, the first/second sealing arrangements and/or any fluid product within the casing.

26 Claims, 13 Drawing Sheets

(51) Int. Cl.
*F04C 13/00* (2006.01)
*F04C 15/00* (2006.01)

(52) U.S. Cl.
CPC ..... *F04C 13/002* (2013.01); *F04C 2230/60* (2013.01); *F04C 2230/604* (2013.01); *F04C 2230/70* (2013.01); *F04C 2240/30* (2013.01)

(58) Field of Classification Search
CPC ..... F04C 2230/60; F04C 2230/604; F04C 2230/70; F04C 2230/80
See application file for complete search history.

(56) References Cited

FOREIGN PATENT DOCUMENTS

| | | | | | |
|---|---|---|---|---|---|
| EP | 1334816 | A1 | | 8/2003 | |
| GB | 625490 | A | | 6/1949 | |
| JP | H04-219484 | A | | 8/1992 | |
| JP | 2002115682 | A | * | 4/2002 | ..... F04C 18/086 |
| JP | 2016-084749 | A | | 5/2016 | |
| JP | 2016217256 | A | | 12/2016 | |

OTHER PUBLICATIONS

DE102012104736 (A1)—Moldenhauer—Rotary pump for viscous fluid medium, has heat exchanger that is associated with temperature control of pump chamber by heat carrier, and is integrated in wall of pump casing—Dec. 5, 2013—the English Machine Translation. (Year: 2013).*

"All Rotary Lobe Pumps Are Not Created Equal", TPO—Treatment Plant Operator, exact publication date unknown, but at least as early as May 6, 2020. https://www.tpomag.com/.

"Chocolate, the food of good cheer" Italian Food Tech, exact publication date unknown, but at least as early as Feb. 27, 2020. https://www.italianfoodtech.com/.

"How does Bonve Rotary lobe pumps with heating jacket work", Huatai Bonve Pumps Co., Ltd., exact publication date unknown, but at least as early as Dec. 3, 2020. https://www.bonvepumps.com/.

"PLP", Tapflo Group, 2020. https://tapflo.co.za/.

"Pomac Rotary Lobe Pumps", User manual, Pomac Pumps, Jun. 2014. https://www.pomacpumps.com/en/.

"Rotary Lobe Pumps" Bellin S.p.a. exact publication date unknown, but at least as early as Dec. 3, 2020. https://bellinpompe.com/.

"Stainless Steel Sanitary Rotary Lobe Pump", Joneng Valves Co.,Limited, Sanitary butterfly Valve, sanitary diaphragm valve, sanitary pipe fitting, manufacturer, supplier, exact publication date unknown, but at least as early as Dec. 3, 20202020. http://jo-neng.com/5-sanitary_rotary_lobe_pump.html.

European Search Report in corresponding Application No. EP 21 15 2412 dated Jul. 7, 2021.

International Search Report (PCT/ISA/210) and Written Opinion (PCT/ISA/237) mailed on May 16, 2022, by the European Patent Office as the International Searching Authority for International Application No. PCT/EP2022/051070. (16 pages).

Office Action (Notice of Reasons for Rejection) issued on May 20, 2024, in corresponding Japanese Patent Application No. 2023-543186 and English translation of the Office Action. (14 pages).

* cited by examiner

A - A

B - B

ROTARY POSITIVE DISPLACEMENT PUMP

TECHNICAL FIELD

The present disclosure relates to a rotary positive displacement pump. The disclosure further relates to a set of rotary positive displacement pumps, as well as a method for heating a rotor casing and/or a fluid product within the rotor casing of a rotary positive displacement pump.

The rotary positive displacement pump according to the disclosure will be described primarily in terms of circumferential piston pump, but the pump according to the disclosure is not restricted to this particular type of pump, but may alternatively be implemented in terms of rotary lobe pump, a gear pump, or the like.

BACKGROUND

Rotary positive displacement pumps are typically used for transporting relatively high viscosity fluid products for among others food, beverage and hygienic applications. Some of these high viscosity fluid products may be in solid phase in a temperature of about 20 degrees Celsius and may thus require heating for being transportable by a pump at room temperature. The pump itself may be equipped with a fluid product heating arrangement for maintaining the fluid product viscosity below a certain level and reducing the risk of fluid product crystallisation or solidification, or for shifting a solidified fluid product within the pump fluid from a solid phase to a fluid phase for enabling operation of the pump.

However, despite the activities in the field, there is a demand for a further improved pump design, e.g. in terms of compactness, cost-efficiency and flexibility.

SUMMARY

An object of the present disclosure is to provide a rotary positive displacement pump, as well as a method for heating a rotor casing and/or a fluid product within the rotor casing of a rotary positive displacement pump, having improved performance in terms of compactness, cost-efficiency and flexibility. This object is at least partly achieved by the features of the independent claims. The dependent claims contain further developments of said pump and method.

According to a first aspect of the present disclosure, there is provided a rotary positive displacement pump for pumping a fluid product, wherein the pump having a front side and a rear side. The pump comprises a transmission housing providing rotational support to first and second parallel and axially extending drive shafts having gears in constant mesh condition, such that the first and second drive shafts are arranged to rotate in opposite directions. The pump further comprises a rotor casing connected to a front side of the transmission housing and having an axial rear wall, an axial front wall and a circumferential side wall jointly defining a stationary interior pumping cavity. The rotor casing houses a first rotor that is drivingly connected to the first drive shaft and a second rotor that is drivingly connected to the second drive shaft. The first and second rotors are configured for rotating in opposite directions and mutually interacting for providing a positive pumping effect on a fluid product that enters the pumping cavity via a rotor casing inlet and exits the pumping cavity via a rotor casing outlet. The rotor casing further includes first and second sealing arrangements configured for preventing fluid product from leaking out from the stationary pumping cavity towards the rear side of the rotor casing along the first and second drive shafts, respectively. The pump further comprises a heating device detachably fastened to the axial rear wall of the rotor casing and configured for heating the rotor casing, the first and second sealing arrangements and/or any fluid product within rotor casing.

According to a second aspect of the present disclosure, there is provided a method for heating a rotor casing and/or a fluid product within the rotor casing of a rotary positive displacement pump having a front side and a rear side. The rotary positive displacement pump comprises a transmission housing and the rotor casing, wherein the transmission housing gives rotational support to first and second parallel and axially extending drive shafts having gears in constant mesh condition, such that the first and second drive shafts are arranged to rotate in opposite directions, wherein the rotor casing is connected to a front side of the transmission housing and having an axial rear wall, an axial front wall and a circumferential side wall jointly defining a stationary interior pumping cavity, wherein the rotor casing houses a first rotor that is drivingly connected to the first drive shaft and a second rotor that is drivingly connected to the second drive shaft, wherein the first and second rotors are configured for rotating in opposite directions and mutually interacting for providing a positive pumping effect on a fluid product that enters the pumping cavity via a rotor casing inlet and exits the pumping cavity via a rotor casing outlet, wherein the rotor casing further includes first and second sealing arrangements configured for preventing fluid product from leaking out from the stationary pumping cavity towards the rear side of the rotor casing along the first and second shafts, respectively. The method comprises detachably fastening a heating device to the axial rear wall of the rotor casing, and activating the heating device for heating the rotor casing, the first and second sealing arrangements and/or any fluid product within the rotor casing.

Alternatively, according to the second aspect of the present disclosure, there is provided a method for heating a rotor casing and/or a fluid product within the rotor casing of a rotary positive displacement pump having a front side and a rear side. The method comprises providing a rotary positive displacement pump having a transmission housing and a rotor casing, wherein the transmission housing gives rotational support to first and second parallel and axially extending drive shafts having gears in constant mesh condition, such that the first and second drive shafts are arranged to rotate in opposite directions, wherein the rotor casing is connected to a front side of the transmission housing and having an axial rear wall, an axial front wall and a circumferential side wall jointly defining a stationary interior pumping cavity, wherein the rotor casing houses a first rotor that is drivingly connected to the first drive shaft and a second rotor that is drivingly connected to the second drive shaft, wherein the first and second rotors are configured for rotating in opposite directions and mutually interacting for providing a positive pumping effect on a fluid product that enters the pumping cavity via a rotor casing inlet and exits the pumping cavity via a rotor casing outlet, wherein the rotor casing further includes first and second sealing arrangements configured for preventing fluid product from leaking out from the stationary pumping cavity towards the rear side of the rotor casing along the first and second drive shafts, respectively. The method further comprises detachably fastening a heating device to the axial rear wall of the rotor casing, and activating the heating device for heating the rotor casing, the first and second sealing arrangements and/or any fluid product within rotor casing.

Prior art solutions for heating the rotor casing and/or the fluid product within the rotor casing involved for example attachment of a heating jacket to a front surface and/or circumferential surface of the rotary casing, or use of a dedicated front cover and/or rotary casing with internal heating fluid channels. However, these prior art solutions resulted in increased total outer size of the pump installation or increased cost due to requirement of development of dedicated front cover or rotary casing. Moreover, the placement of the heating source at the front cover or circumferential wall of the rotary casing, i.e. relatively far away from the first and second sealing arrangements of the rotary casing, meant that the rotor casing in the region close to the first and second sealing arrangements heated up relatively slowly and there was an increased risk of damage to the first and second sealing arrangements due to still solidified product in the vicinity of said seals when starting rotation of the rotors for operation of the pump.

These problems and disadvantages of the prior art solutions are largely overcome, or at least reduced, by attaching the heating device to the axial rear wall of the rotor casing. In particular, by having the heating device manufactured as a separate part that may be attached, or not, to the rear wall of the rotor casing, means that less individual variations of the rotary casing must be developed and managed, thereby providing improved product cost-efficiency.

Since the heating device is detachably fastened to the axial rear wall of the rotor casing, the heating device can be provided as an option. Since the heating device is detachably fastened, the heating device can be mounted on an existing pump. The heating device can be delivered together with a new pump if the application and media require heating. The heating device can be supplied and mounted on an existing pump as a retrofit if the application and media is changed to require heating. No special rotor casing is needed for providing a pump with a heating device. Nor is it necessary to provide all pumps with a heating device regardless if heating is required or not. Only one type of rotor casing is needed regardless if a pump is to be provided with a heating device or not.

Moreover, the attachment of the heating device to the axial rear wall of the rotor casing, i.e. in a space between the rotary casing and the transmission casing, the outer dimensions of the pump may be largely unaffected by the heating device. In other words, the outer dimensions of the pump in the horizontal and vertical directions may remain largely or completely the same with or without the heating device installed. Thereby, existing installations may be easily and cost-efficiently complemented with heating devices without requiring additional modifications of the pumping equipment, thereby enabling easy change of fluid product or fluid product operating conditions, for example when shifting to a fluid product that requires heating.

In addition, by the placement of the heating device at the rear wall of the rotary casing, the heating device is arranged relatively close to the first and second sealing arrangements of the rotary casing. Consequently, the rotor casing, in particular in the region close to the first and second sealing arrangements, as well as the first and second sealing arrangements, may be heated up relatively fast for increasing the likelihood that the product in the vicinity of said seals is actually in fluid form when starting rotation of the rotors for operation of the pump. In other words, the closeness of the heating device at the rear wall of the rotary casing means that the risk of damage to the first and second sealing arrangements due to still solidified product in the vicinity of said seals when starting rotation of the rotors for operation of the pump may be reduced.

Consequently, detachably attachment of the heating device to the axial rear wall of the rotor casing for heating the rotor casing in a region close to the first and second sealing arrangements and/or any fluid product within rotor casing provides improved performance in terms of compactness, cost-efficiency and flexibility.

Further advantages are achieved by implementing one or several of the features of the dependent claims.

The heating device may be detachably fastened such that the heating device is attachable, detachable and reattachable. More precisely, the heating device may be attachable to the axial rear wall of the rotor casing, detachable from the axial rear wall of the rotor casing and reattachable to the axial rear wall of the rotor casing. The heating device may be removably fastened to the axial rear wall of the rotor casing. The heating device may be reattachably fastened to the axial rear wall of the rotor casing. Thus, the heating device may be removably and reattachably fastened to the axial rear wall of the rotor casing.

The heating device may be detachably fastened such that the heating device is releasable. More precisely, the heating device may be releasable from the axial rear wall of the rotor casing.

The heating device may be detachably fastened by fasteners. The heating device may be detachably fastened by releasing fasteners, i.e. fasteners releasing the heating device or more precisely fasteners capable of releasing the heating device. The fasteners may be removable. The fasteners may be threaded fasteners. Alternatively, the fasteners may be clamping members, such as brackets.

The heating device may be a separate part. The heating device may be a separate part that is detachably fastened to the axial rear wall of the rotor casing. The heating device may be separate from the rotor casing. The heating device may be a separate part that is separate from the rotor casing. The heating device may be a separate part in relation to the rotor casing. The heating device may be separable from the rotor casing. The heating device may be a separate part that is separable from the rotor casing.

In some example embodiments, the heating device is a heating casing having an internal fluid heating chamber, a fluid inlet and a fluid outlet, wherein the internal fluid heating chamber is fluidly connected to the fluid inlet and the fluid outlet. Thereby, a heat transfer fluid may be used for heating and/or cooling the rotor casing.

In some example embodiments, the internal fluid heating chamber is partly defined by the heating casing and partly be the rear wall of the rotor casing. This enables direct contact of the heat transfer fluid with the rotor casing for improved heating and/or cooling efficiency.

In some example embodiments, the heating casing has an elongated channel formed in a surface of the heating casing, wherein the elongated channel faces towards the axial rear wall of the rotor casing, and wherein an elongated interior surface of the elongated channel and a surface of the rear wall jointly define the internal fluid heating chamber. This enables direct contact of the heat transfer fluid with the rotor casing for improved heating and/or cooling efficiency and the elongated channel ensures a relatively large contact area for the heat transfer fluid.

In some example embodiments, the elongated channel is formed in a flat exterior surface of the heating casing, wherein the flat exterior surface surrounding the channel is in contact with and pressed against a corresponding flat surface of the rear wall of the rotor casing. Thereby, sealing of the elongated channel is simplified due to the planar contact surface.

In some example embodiments, the elongated channel is machined in the flat exterior surface of the heating casing, or the elongated channel is formed in the flat exterior surface of the heating casing in connection with casting of the heating casing. This enables a cost-efficient manufacturing of the heating casing.

In some example embodiments, the elongated channel extends over at least 50%, specifically at least 75%, of a total length of the heating casing, in a direction perpendicular to an axial direction of the pump. Thereby, a relatively large surface portion of the heating casing may be used for providing direct contact between the heat transfer fluid and the rotor casing.

In some example embodiments, the elongated channel has a length of about 5-30 cm, wherein a main part of the elongated channel has a depth of 5-30 mm and a width of about 5-30 mm. This ensures that the heating channel is not too small, because this would reduce the efficiency of the heat transfer efficiency.

In some example embodiments, the elongated channel follows a curved path from the fluid inlet to the fluid outlet, wherein the curved path is curved around the cylindrical outer surface of the first and/or second drive shaft. This enables the heating device to be located relatively close to a larger region of the rotor casing that supports the sealing arrangements.

In some example embodiments, the heating casing has a seal arranged at the flat surface of the heating casing and extending around the elongated channel for preventing leakage of heating fluid at a contact region between the heating casing and rotor casing. Provision of the seal at a flat surface enables improved leakproofness, use of a less complicated seal and a more cost-efficient manufacturing of any associated sealing groove.

In some example embodiments, the seal is O-ring seal arranged in circumferential sealing groove provided in the flat surface of the heating casing. Thereby, a cost-efficient design is provided both in terms of cost for seal and manufacturing of the sealing groove.

In some example embodiments, the heating device has a flat surface that is pressed against a corresponding flat surface of the rear wall of the rotor casing. A flat surface enables cost-efficient manufacturing and a relatively large contact surface for efficient heat transfer.

In some example embodiments, the heating device is pressed against the rear wall of the rotor casing by means of threaded fasteners that engage in threaded holes located in the rear wall of the rotor casing. This design provides a cost-efficient solution that enables easy attachment and detachment of the heating devices to the rotor casing.

In some example embodiments, the heating device has a curved surface that bends around and follows at least a portion of the cylindrical outer surface of the first and/or second drive shaft. This enables the heating device to be located relatively close to a larger region of the rotor casing that supports the sealing arrangements.

In some example embodiments, a contact surface between the heating device and axial rear wall of the rotor casing, as viewed in an axial direction of the pump, extends over at least ⅓ of the circumference of the first or second drive shaft. This enables the heating device to be located relatively close to a larger region of the rotor casing that supports the sealing arrangements.

In some example embodiments, the pump has an axial direction parallel with the first and second drive shafts, a first lateral direction extending perpendicular to the axial direction and through rotational centres of the first and second drive shafts, wherein the pump comprises a first heating device arranged on an outer side of the first drive shaft, in the first lateral direction, and wherein the pump comprises a second heating device arranged on an outer side of the second drive shaft, in the first lateral direction. The areas outside of the first and second drive shafts are often less used for bearing support and/or rotor casing fluid product inlet/outlet, thereby providing more space for the heating devices.

In some example embodiments, the first heating device substantially or completely surrounds the first drive shaft, and wherein the second heating device substantially or completely surrounds the second drive shaft. This enables the first and second heating device to be located relatively close to a larger region of the rotor casing that supports the sealing arrangements.

In some example embodiments, the pump comprises a single heating device detachably fastened to the axial rear wall of the rotor casing, wherein said single heating device surrounds both the first and second drive shafts. A single heating device generally enables a more cost-efficient design because manufacturing, handling and mounting of merely a single component is required.

In some example embodiments, the heating device does not influence the exterior pump dimensions. This is advantageous in terms of a more flexible use of the pump because heating and/or cooling feature may be added to the pump at a later stage without requiring additional modification of the pump installation.

In some example embodiments, the transmission housing comprises first and second axially protruding attachment portions facing the rotor casing and located on opposite sides of the drive shafts, wherein the rotor casing is connected to the front side of the transmission housing via the first and second axially protruding attachment portions, such that an intermediate space is provided between the transmission housing and rotor casing, and wherein the heating device is arranged in said intermediate space. This enables good access to the intermediate space for visual inspection of the heating devices and/or for connection of heat transfer fluid supply and return piping to the heating devices.

In some example embodiments, the rear wall of the rotor casing has a recess defined by a flat surface perpendicular to an axial direction of the pump and facing towards the rear side of the pump, and by a radial surface facing in a direction perpendicular to said axial direction, wherein the heating device has a flat surface pressed against the flat surface of the recess and a radial surface facing the radial surface of the recess. The recess not only enables a less protruding heating device but also improved heating efficiency due to heating of the rotary casing in both axial and radial directions.

The axial direction of the pump herein refers to a direction parallel with the first and second drive shafts.

A direction perpendicular to said axial direction include for example the first lateral direction extending perpendicular to the axial direction and through rotational centres of the first and second drive shafts, or a second lateral direction that is perpendicular to both the axial direction and the first lateral direction, or any other direction perpendicular to said axial direction.

In some example embodiments, the rotor casing has a first cylindrical rotor case hub and a second cylindrical rotor case hub, each extending from the axial rear wall of the rotor casing, wherein the stationary interior pumping cavity is defined by the axial rear wall, the circumferential side wall, the front wall and the first and second cylindrical rotor case hubs, wherein the first cylindrical rotor case hub receives internally therein the first drive shaft and the second cylindrical rotor case hub receives internally therein the second drive shaft, wherein the first sealing arrangement is located at least partly within an annular space defined by an exterior surface of the first drive shaft and an interior surface of the first hub, and wherein the second sealing arrangement is located at least partly within an annular space defined by an exterior surface of the second drive shaft and an interior surface of the second hub. The first and second hubs may serve as good heat-conductors for heating of the regions of the first and second sealing arrangements, and by positioning of the heating devices at the rear wall of the rotor casing and relatively close the first and second hubs, efficient heating of the area of the sealing arrangements may be accomplished.

The disclosure also concerns a set of rotary positive displacement pumps. The set includes: a first rotary positive displacement pump as described above having a first displacement volume per revolution; and a second rotary positive displacement pump as described above having a second displacement volume per revolution that is larger than the first displacement volume per revolution. Both the first and second rotary positive displacement pumps are configured for having identical heating devices fastened to the axial rear wall of the rotor casings. This provides a more cost-efficient solution because less individual components must be designed, handled and managed.

In some example embodiments, the method comprises deactivating the heating device for terminating heating and detaching the heating device from the axial rear wall of the rotor casing.

In some example embodiments, the step of detachably fastening a heating device to the axial rear wall of the rotor casing involves attaching the heating device to the axial rear wall of the rotor casing. Thus, in some example embodiments, the method comprises attaching the heating device to the axial rear wall of the rotor casing before activating the heating device. In some example embodiments, the method comprises deactivating the heating device for terminating heating and detaching the heating device from the axial rear wall of the rotor casing. In some example embodiments, the method comprises reattaching the heating device to the axial rear wall of the rotor casing and reactivating the heating.

In some example embodiments of the method, the heating device is detachably fastened to the axial rear wall of the rotor casing by means of fasteners, such as releasing fasteners.

Further features and advantages of the invention will become apparent when studying the appended claims and the following description. The skilled person in the art realizes that different features of the present disclosure may be combined to create embodiments other than those explicitly described hereinabove and below, without departing from the scope of the present disclosure.

BRIEF DESCRIPTION OF DRAWINGS

The pump according to the disclosure will be described in detail in the following, with reference to the attached drawings, in which.

DESCRIPTION OF EXAMPLE EMBODIMENTS

Various aspects of the disclosure will hereinafter be described in conjunction with the appended drawings to illustrate and not to limit the disclosure, wherein like designations denote like elements, and variations of the described aspects are not restricted to the specifically shown embodiments, but are applicable on other variations of the disclosure.

Figure 1:
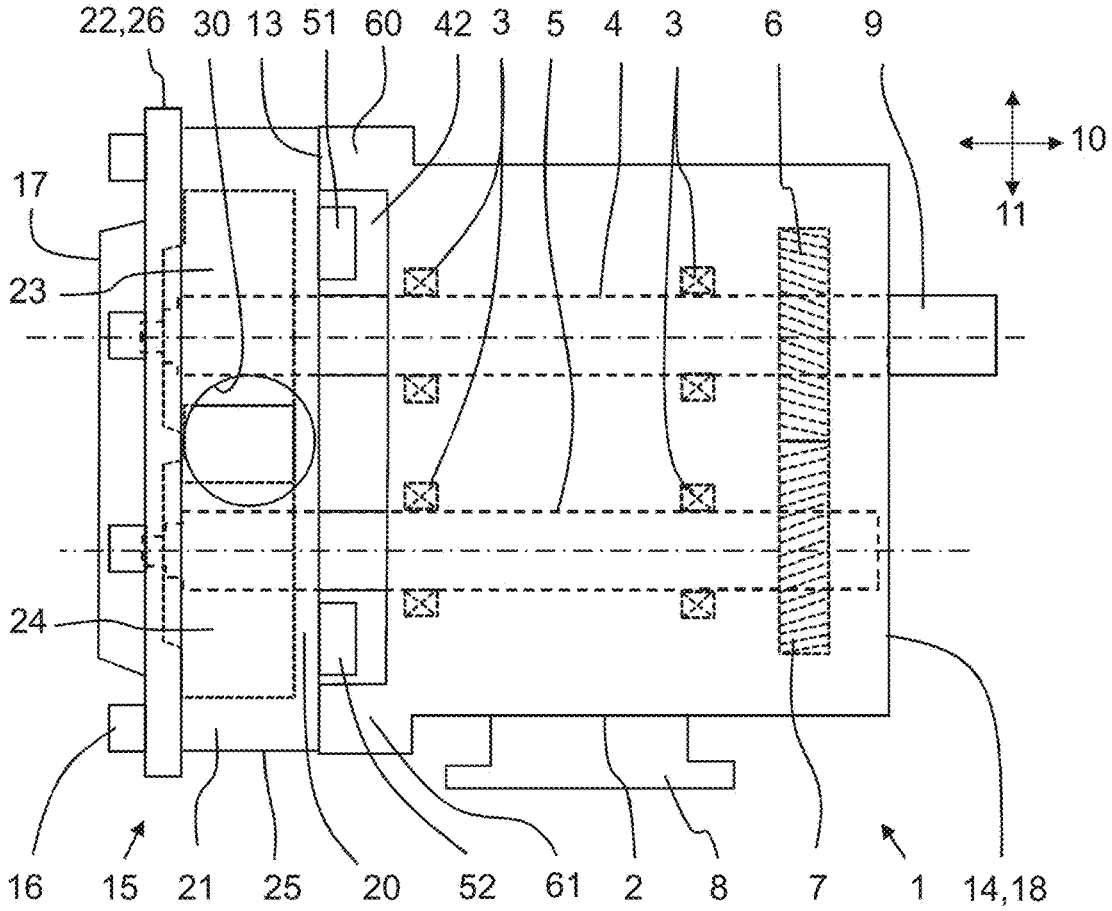
FIG. 1 shows schematically a side-view of an example embodiment of the pump.

FIG. 1 schematically shows a side view of a first example embodiment of the rotary positive displacement pump 1 for pumping a fluid product according to the disclosure. The pump 1 has a transmission housing 2 including rotational support 3 to first and second parallel drive shafts 4, 5, which extend in an axial direction 10 of the pump 1. The rotational support 3 may for example be provided in form of a set of annular rolling bearings, each of which surrounds one of the first and second drive shafts 4, 5 and is fastened to the transmission housing 2.

The first axially extending drive shaft 4 carries a first gear 6 and the second axially extending drive shaft 5 carries a second gear 7. The first and second gears 6, 7, i.e. gear wheels, are arranged in constant mesh condition, meaning that they are in constant gear engagement with each other. Moreover, since the first and second gears 6, 7 are in directing engagement with each other they rotate in opposite directions.

The transmission housing 2 has a first length in the axial direction 10, a second length in a first lateral direction 11 that is perpendicular to the axial direction 10, and a third length in a second lateral direction 12 that is perpendicular to both the axial direction 10 and the first lateral direction 11. The transmission housing further has a front side 13 and a rear side 14, as seen in the axial direction 10.

An end portion 9 of one of the first and second drive shafts 4, 5, such as for example the first drive shaft 4, may extend out through a wall of the transmission housing 2 at the rear side of the transmission housing 2 for rotational connection with a rotational torque source, such as for example a motor, for powering the pump 1.

The transmission housing 2 may be made of metal, such as for example stainless steel, cast iron, steel or aluminium alloy, and the first and second drive shafts 4, 5 may be made of steel.

The transmission housing 2 may additionally include a support structure 8 for enabling attachment of the transmission housing 2 to an exterior support surface, for example by means of threaded bolts or other type of fasteners. The transmission housing may be made in one piece or composed of multiple sub-parts.

In the example embodiment of the pump illustrated in FIG. 1, the pump 1 further comprises a rotor casing 15 connected to the transmission housing 2 at the front side 13 of the transmission housing 2. The rotor casing 15, which for example is made of stainless steel, may be removably fastened to the front side 13 of the transmission housing 2 via a suitably fastening arrangement. For example, the rotor casing 15 may be clamped against the front side 13 of the transmission housing 2 by means of a plurality of threaded bolts or nuts 16 or similar threaded members.

Figure 2:
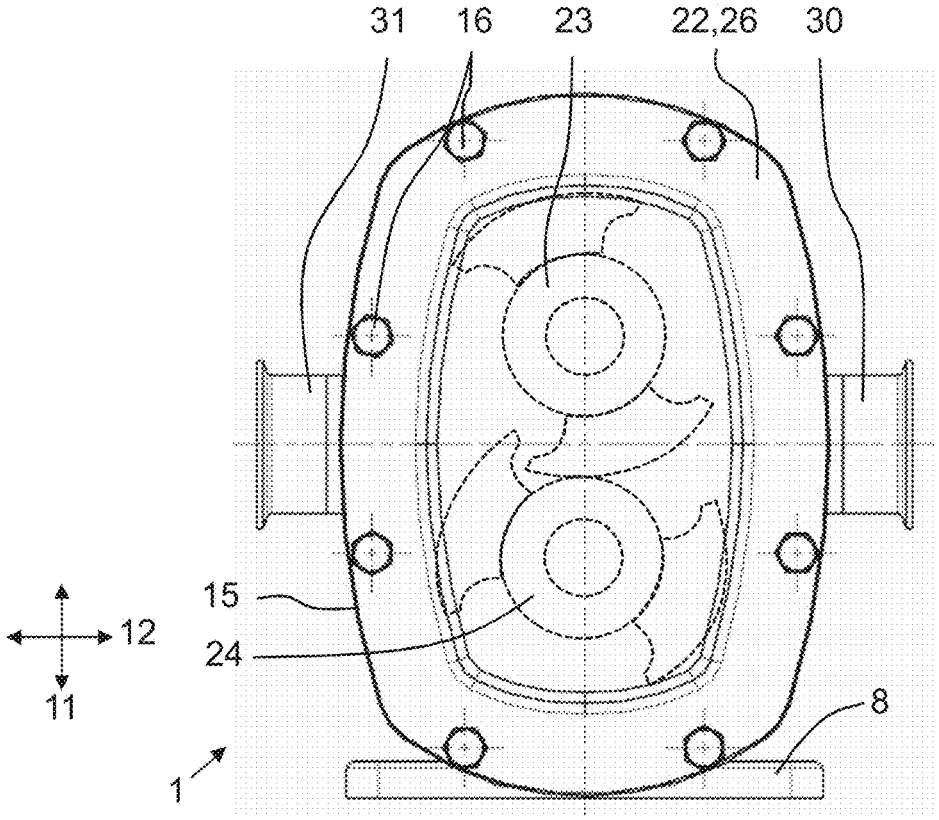
FIG. 2 shows schematically a front-view of an example embodiment of the pump.

The assembled pump 1 including the transmission housing 2 and the rotor casing 15 has a front side 17 and a rear side 18, and a front view of the pump 1 of FIG. 1 is schematically shown in FIG. 2, wherein first and second rotors 23, 24 located within the rotor casing 15 are illustrated with dotted lines.

As can be seen in FIG. 2, the plurality of threaded bolts or nuts 16 used for clamping the rotor casing 15 may extend through the entire rotor casing 15 and be visible from the front side 17 of the pump 1.

In the example embodiment of FIGS. 1 and 2, the rotor casing 15 comprises an axial rear wall 20, a circumferential side wall 21 and an axial front wall 22, which jointly defines a closed stationary interior pumping cavity.

Since the rotor casing 15 houses first and second rotors 23, 24 located within the interior pumping cavity, the rotor casing 15 is openable for enabling access to the interior pumping cavity. In the example embodiment of FIGS. 1 and 2, this access is made possible by making the rotor casing 15 in two parts: a rotor casing rear portion 25 including the axial rear wall 20 and circumferential side wall 21 of the rotor casing 15, and a separate front cover 26 acting as the axial front wall 22 of the rotor casing 15, wherein the removable front cover 26 is removably fastened to the rotor casing rear portion 25 by a suitable attachment arrangement.

Figure 3:
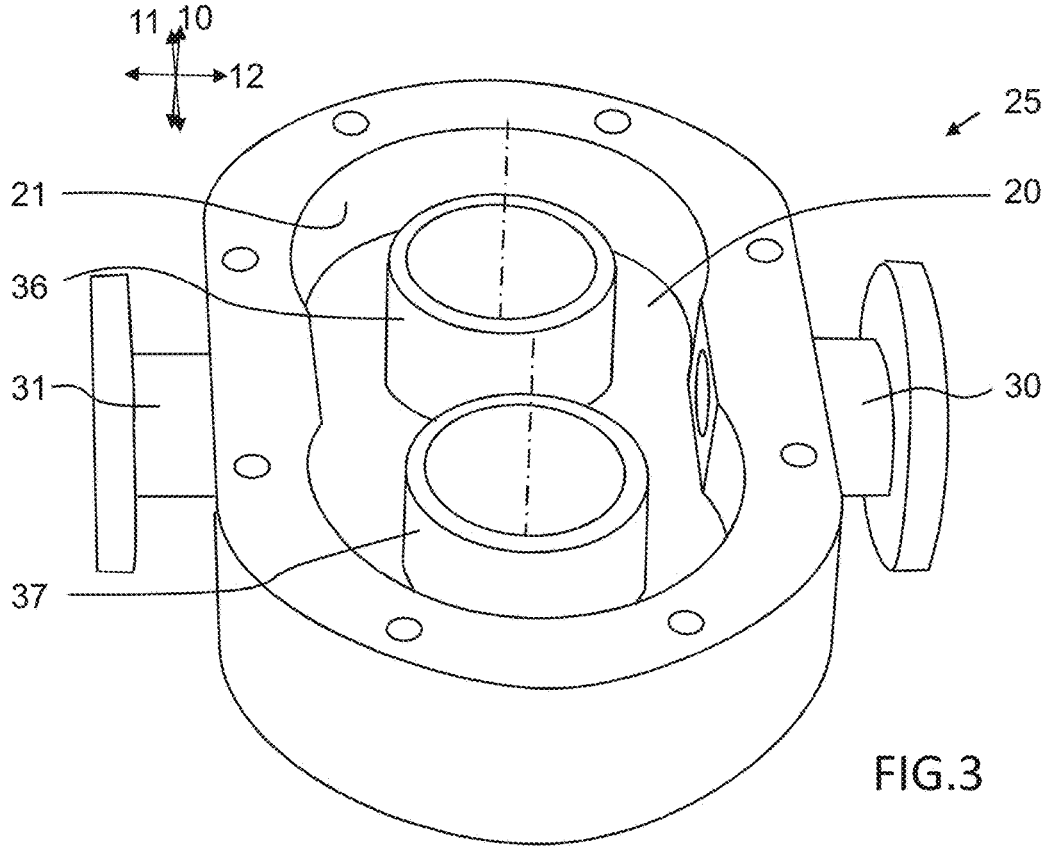
FIG. 3 shows schematically a perspective view of a rotor casing rear portion according to an example embodiment of the pump.

A schematic 3D view of an example embodiment of a rotor casing rear portion 25 according to the disclosure is provided in FIG. 3, as seen partly from a front side of the rotor casing rear portion 25.

The removable front cover 26 may be clamped against the rotor casing rear portion 25 by means of the same plurality of threaded bolts or nuts 16 that are used for clamping the rotor casing 15 against the front side 13 of the transmission housing 2. Alternatively, separate attachment arrangements may be provided for attaching the front cover 26 to the rotor casing rear portion 25.

In the example embodiment of FIGS. 1-3, the rotor casing 15 further includes a fluid product inlet opening 30 for enabling a fluid product to enter, e.g. being sucked into, the interior pumping cavity, and a fluid product outlet opening 31 for enabling the fluid product to exit, e.g. being pumped out of, the interior pumping cavity.

As mention above, the rotor casing 15 furthermore houses the first and second rotors that are configured for generating the pumping functionality of the pump. The first rotor 23 is rotationally fastened to a front end of the first drive shaft 4 and the second rotor 24 is rotationally fastened to a front end of the second drive shaft 5. Consequently, the first and second rotors 23, 24 are configured to rotate in mutually opposite directions, as illustrated by arrows in FIG. 5.

Figure 4:
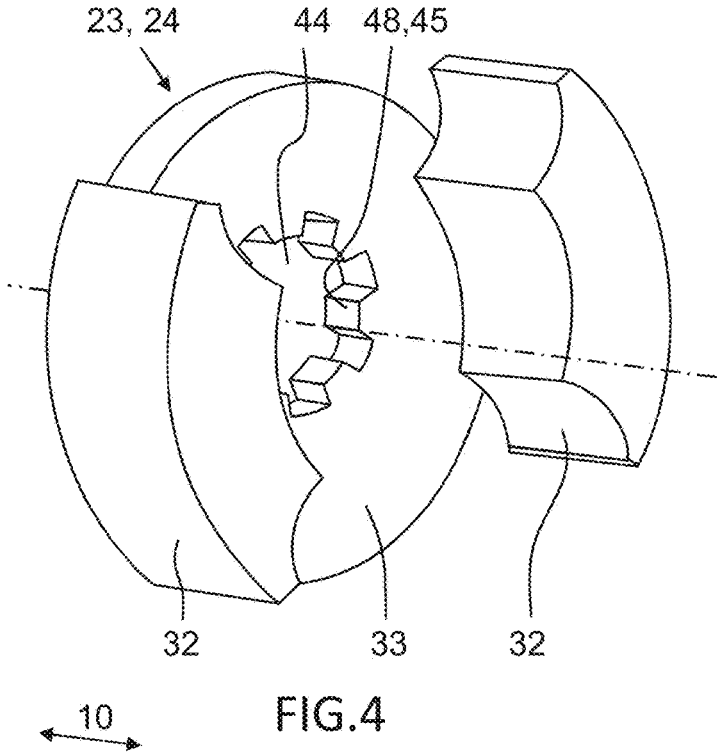
FIG. 4 shows schematically a perspective view of an example embodiment of a rotor of the pump.

An example embodiment of the first and second rotors 23, 24, which may have substantially identical design, are schematically illustrated in FIGS. 1 and 2, and a 3D view of an example embodiment of one of the first and second rotors 23, 24, as seen partly from a rear side, is provided in FIG. 4.

Each of the first and second rotors 23, 24 has at least one, and preferably a plurality of, rotor wings 32 and a rotor drive element 33 that is configured to be mounted torque proof on a rotor seat of an associated drive shaft 4, 5.

The rotor drive element 33 of each rotor 23, 24 may be substantially disc-shaped or sleeve-shaped and including a central hole or recess 44 for mounting on the associated drive shaft 4, 5. The hole or recess 44 may be defined by a cylindrical mounting surface 48 having splines 45, or by a non-circular mounting surface for enabling torque proof mounting of the rotor on the rotor seat of the associated drive shaft 4, 5.

Figure 5:
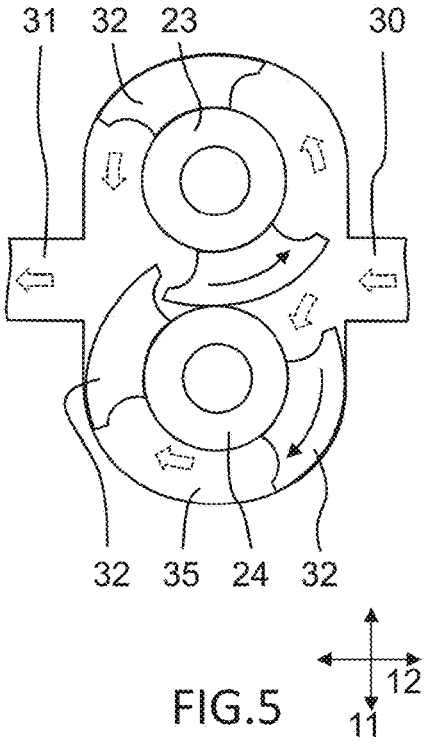
FIG. 5 shows schematically a principle of pumping operation according to an example embodiment of the pump.

With reference to FIG. 5, in this example embodiment of the pump 1, during operation of the pump 2, the first and second rotors 23, 24 are configured to rotate in opposite directions with the same rotational speed. The first and second rotors 23, 24 are configured to define a pumping volume within a space 35 restricted by the neighbouring rotor wings of the same rotor and the walls 20, 21, 22 of the interior pumping cavity. Moreover, during rotation of the first and second rotors 23, 24, the fluid product is configured to be conveyed from the fluid product inlet opening 30, along an outer side of each rotor 23, 24 and to the fluid product outlet opening 31, illustrated by the arrows in FIG. 5.

In particular, when the rotor wings (pistons) 32 rotate around the circumference of the pumping cavity, they continuously generates a partial vacuum at the product inlet opening 30 as the first and second rotors 23, 24 unmesh, causing fluid product to enter the pump 1. The fluid product is subsequently transported around the pumping cavity by the rotor wings 32. A direction of flow generated by the pump 1 is reversible by simply shifting the direction of rotation of the first and second rotors 23, 24.

The specific form and number of rotor wings 32 may vary considerably and the specific rotor twin-wing design illustrated in FIGS. 2, 4 and 5 is merely one example embodiment of rotor wings, and the pump may thus have rotors 23, 24 with other types of rotor wing designs according to the disclosure.

With reference to FIG. 3, the rotor casing 15 may comprise a first cylindrical rotor case hub 36 extending from the rear wall 20, and second cylindrical rotor case hub 37 extending from the rear wall 20. The first and second hubs 36, 37 are essentially hollow cylindrical sleeves that are open towards both axial sides thereof. Moreover, an axial direction of each cylindrical hub 36, 37 is aligned with the axial direction 10 of the pump 1.

The first rotor case hub 36 is configured to receive the first drive shaft 4, and the second rotor case hub 37 is configured to receive the second drive shaft 5. In other words, in an assembled state, the first rotor case hub 36 is aligned with the first drive shaft 4, and the second rotor case hub 37 is aligned with the second drive shaft 5. The first and second hubs 36, 37 are thus displaced from each other in the first lateral direction 11.

Prior to assembly of the transmission housing 2 with the rotor casing 15, the front ends of the first and second drive shafts 4, 5 protrude forwards beyond the front surface 13 of the transmission housing. Subsequently, upon assembly of the transmission housing 2 with the rotor casing 15, said front ends of the first and second drive shafts 4, 5 are inserted from a rear side into the first and seconds hubs, respectively, and a rear side of the rotor casing 15 comes into contact with the front surface 13 of the transmission housing 2. In this state, the front ends of the first and second drive shafts 4, 5 extend through the complete axial length of the first and seconds hubs 36, 37.

Figure 6:
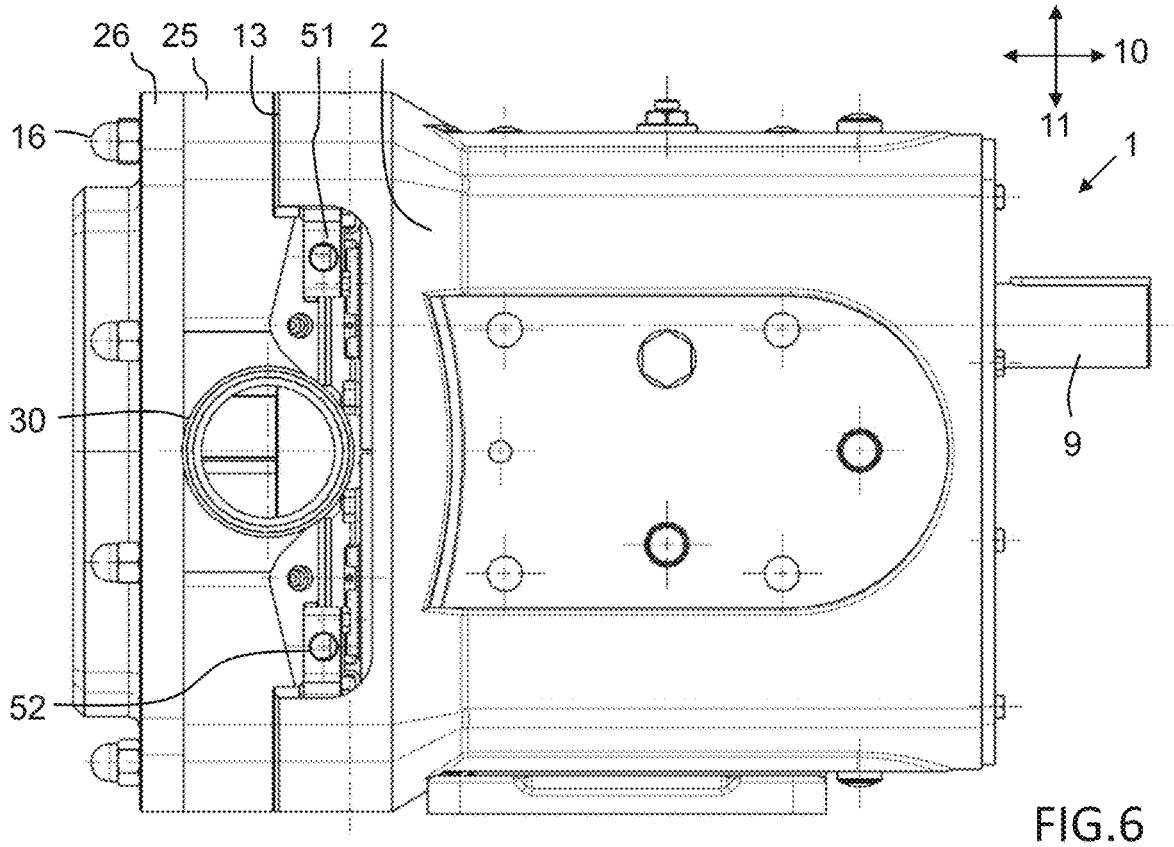
FIG. 6 shows schematically a side-view of an example embodiment of the pump.
Figure 7:
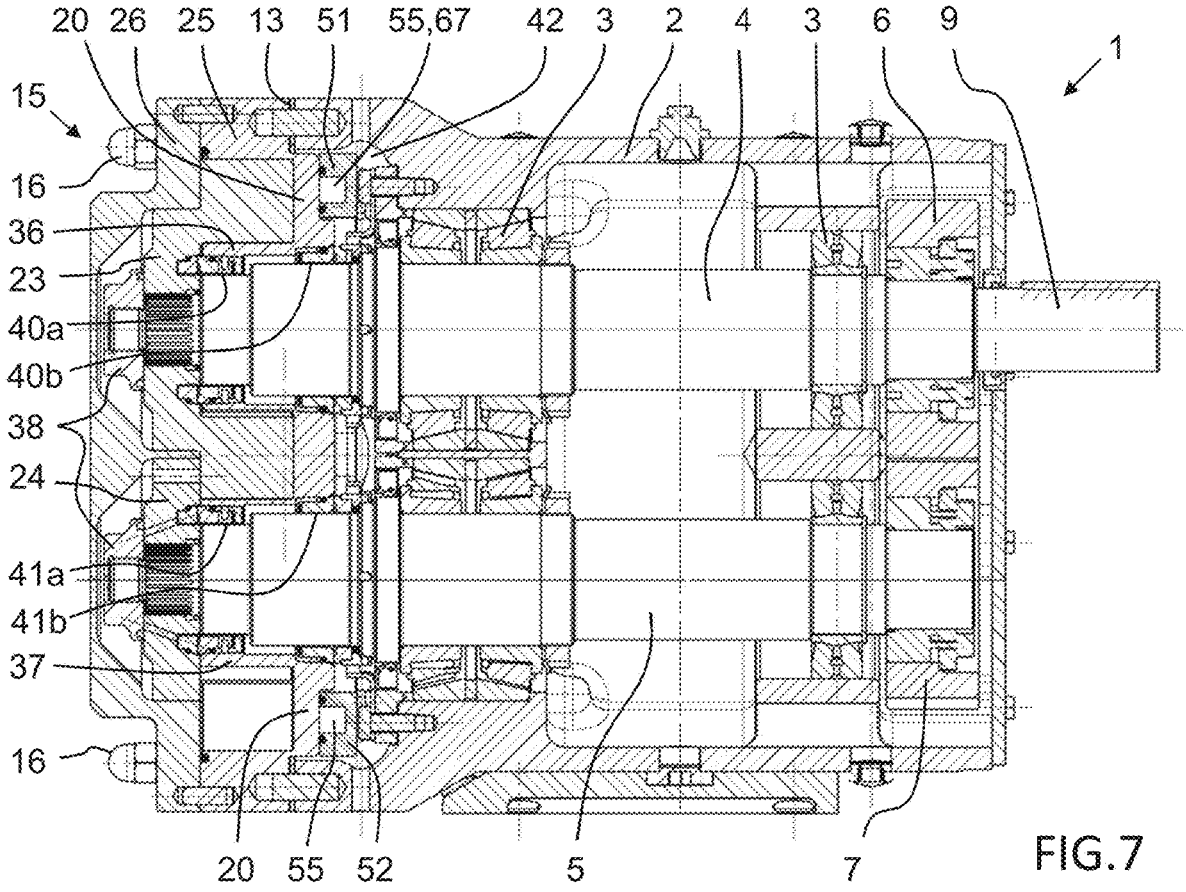
FIG. 7 shows schematically a cross-section of a side-view of an example embodiment of the pump.

FIG. 6 shows a more detailed side-view of an example embodiment of the pump 1, and FIG. 7 shows a cross-sectional side view of the same pump 1 in an assembled state.

As schematically illustrated in FIGS. 1, 6 and 7, the transmission housing 2 may for include first and second axially protruding attachment portions 60, 61 facing the rotor casing 15 and located on opposite sides of the drive shafts 4, 5. The rotor casing 15 may then be connected to the front side 13 of the transmission housing 2 via said first and second axially protruding attachment portions 60, 61, such that an intermediate space 42 is accomplished between the transmission housing 2 and rotor casing 25.

With reference to FIGS. 6 and 7, the rotor casing 15 comprises the rotor casing rear portion 25 and the front cover 26, threaded fasteners 16 for clamping the rotor casing 15 against the front surface 13 of the transmission housing 2. The first and second rotors 23, 24 are mounted torque proof on the first and second drive shafts 4, 5, respectively. Specifically, each of the first and second rotors 23, 24 is secured to a rotor seat of the associated drive shaft 4, 5 by means of a threaded fastener 38 that is engaged with a mating threaded section at an end region of the associated drive shaft 4, 5.

Moreover, the first rotor case hub 36 is provided with a first sealing arrangement 40*a*, 40*b* and the second rotor case hub 37 is provided with a second sealing arrangement 41*a*, 41*b*. Both the first and second sealing arrangements 40*a*, 40*b*, 41*a*, 41*b* are arranged for preventing leakage of fluid product located within the stationary pumping cavity towards the rear side of the rotor casing along the first and second shafts 4, 5.

Each of the first and second sealing arrangements 40*a*, 40*b*, 41*a*, 41*b* may for example include single of double annular sealing assemblies.

In the example embodiment of FIG. 7, each of the first and second sealing arrangements 40*a*, 40*b*, 41*a*, 41*b* include double annular sealing assemblies. This includes a front annular sealing assembly 40*a*, 41*a* and a rear annular sealing assembly 40*b*, 41*b*, wherein the rear sealing assembly 40*b*, 41*b* is arranged spaced apart from the front sealing assembly 40*a*, 41*a*, in the axial direction 10.

Each of the first and second annular sealing assemblies 40*a*, 40*b*, 41*a*, 41*b* may for example be implemented in form of a mechanical face-seal assembly having two main sealing parts, a first annular sealing part associated with the rotor case hub and a second annular sealing part associated with rotor, wherein the first and second sealing parts are held in sealing contact against each other in the axial direction while allowing relative rotation. Alternatively, other types of seals may be used.

As indicated above, the pump 1 may be used for pumping a fluid product that may begin to solidify and/or crystalize when the temperature of the fluid product drops below a certain threshold. This may for example occur during pump stillstand and may then cause damages to the pump when the pump is subsequently started again. In particular, the first and second annular sealing arrangements 40*a*, 40*b*, 41*a*, 41*b* are at risk of being damaged due to their relatively delicate design and narrow tolerance range, but also other parts, such as the first and second cylindrical rotor case hubs 36, 37 or the first and second rotors 23, 24 may be damaged.

Consequently, it is desirable to heat any solidified and/or crystallized fluid product within the pump 1 before starting pumping operation, such that any solidified and/or crystallized fluid product may shift to a fluid state before starting rotation of the rotors 23, 24

With reference to FIGS. 1, 6 and 7, the pump comprises first and second heating devices 51, 52 detachably fastened to the axial rear wall 20 of the rotor casing 15. The first and second heating devices 51, 52 are arranged in the intermediate space 42 between the transmission housing 2 and the rotor casing 15 and configured for heating the rotor casing 15 in a region close to the first and second sealing arrangements 40*a*, 40*b*, 41*a*, 41*b* and/or any fluid product within rotor casing.

In other words, the rotary positive displacement pump 1 according to the present disclosure comprises a transmission housing 2 providing rotational support to first and second parallel and axially extending drive shafts 4, 5 having gears 6, 7 in constant mesh condition, such that the first and second drive shafts 4, 5 are arranged to rotate in opposite directions. The pump further comprises a rotor casing 15 connected to a front side 13 of the transmission housing 2 and having an axial rear wall 20, an axial front wall 26 and a circumferential side wall 25 jointly defining a stationary interior pumping cavity. The rotor casing 15 houses a first rotor 23 that is drivingly connected to the first drive shaft 4 and a second rotor 24 that is drivingly connected to the second drive shaft 5, wherein the first and second rotors 23, 24 are configured for rotating in opposite directions and mutually interacting for providing a positive pumping effect on a fluid product that enters the pumping cavity via a rotor casing inlet 30 and exits the pumping cavity via a rotor casing outlet 31. The rotor casing 15 further includes first and second sealing arrangements 40*a*, 40*b*, 41*a*, 41*b* configured for preventing fluid product from leaking out from the stationary pumping cavity towards the rear side of the rotor casing along the first and second shafts, respectively. The pump further comprises a heating device 51, 52 detachably fastened to the axial rear wall 20 of the rotor casing 15 and configured for heating the rotor casing 15 in a region close to the first and second sealing arrangements 40*a*, 40*b*, 41*a*, 41*b* and/or any fluid product within rotor casing 15.

The term "close" hereinabove means that positioning and attachment of the heating device 51, 52 at the axial rear wall 20 of the rotor casing 15 is significantly closer to the region of the rotor casing 15 that holds the first and second sealing arrangements 40*a*, 40*b*, 41*a*, 41*b* than for example positioning of a heating device at the front cover 26 or at the circumferential side wall 21, when considering the heat conductive path length within the metal material of the rotor casing.

In other words, even if a heating device positioned at the front cover 26 possibly may be located physically closer to the region of the rotor casing 15 that holds the first and second sealing arrangements 40*a*, 40*b*, 41*a*, 41*b* than a heating device positioned at the rear wall 20 of the rotor casing, the heat conductive length within the metal material of rotor casing 15 is generally significantly shorter if the heating device is arranged at the rear wall 20, because the region of the rotor casing 15 that holds the first and second sealing arrangements 40*a*, 40*b*, 41*a*, 41*b* is generally integrally formed with the rear wall 20 of the rotor casing, and not with front wall 26 or circumferential side wall 21.

For these reasons, the location of the heating device at the axial rear wall 20 of the rotor casing 15 may be deemed particularly suitable for heating the rotor casing 15 in a region close to the first and second sealing arrangements 40*a*, 40*b*, 41*a*, 41*b*.

The heating device 51, 52 transmits heat to the axial rear wall 20 of the rotor casing 15. The heating device 51, 52 may for example be implemented in form of a heat-exchanger for a circulating or non-circulating heat transfer fluid, or a condenser of a heat pump, or an electrical heating device, or the like.

For example, the heating device 51, 52 may be an electrical heating device that converts electrical power to heat. An electrical heating device may include electrical wires and coils that generate heat when conducting electrical current. Alternatively, the electrical heating device may be positive temperature coefficient (PTC) heater having conductive inks printed on thin, flexible polymer-based substrate. The electrical heating device is typically implemented in form of a Bolt-On External Heater that is fastened to the axial rear wall 20 of the rotor casing 15, and which functions by heating the rotor casing block by direct contact. Still more alternatively, the electrical heating device may be implemented in form of electrical infrared heating device that is attached to the axial rear wall 20 of the rotor casing 15 and heats the rear wall 20 by infrared radiation generated by an electrical element, such as a coiled electrical resistance wire.

When the heating device is implemented in form of a condenser of a heat pump, heat from the condenser of the heat pump is conveyed to the axial rear wall 20 of the rotor casing 15. This heat may be transferred from the condenser to the rotor casing block by direct contact.

When the heating device is implemented in form of a heat-exchanger for a circulating or non-circulating heat transfer fluid, the heating device is configured for having an internal flow of heat transfer fluid, and the heating device enables transfer of heat from the heat transfer fluid to the rear wall 20 of the rotor casing 15. Moreover, the heating device may also, when implemented as a fluid heat-exchanger be used for cooling of the fluid product of the pump 1.

The heating device may be part of a heating system that includes a closed flow path with a pump for circulating the heat transfer fluid within the flow path, a heat source for heating the heat transfer fluid, and the heating device for transferring heat from the heat transfer fluid to the rear wall 20 of the rotor casing 15.

Each of the first and second heating devices 51, 52 illustrated in the example embodiment of FIGS. 1, 6 and 7 include an internal fluid heating chamber 55 that is open towards the axial rear wall 20 of the rotor casing 15. Hence, heat transfer fluid that flows through each of the first and second heating devices 51, 52 is in direct contact with both the inner surface of the internal fluid heating chamber 55 and the rear wall 20 of the rotor casing 15.

The pump 1, rotor casing 15 and first and second heating devices 51, 52 according to the example embodiment of FIGS. 1, 6 and 7 are further described below with reference to FIGS. 8-12B.

Figure 8:
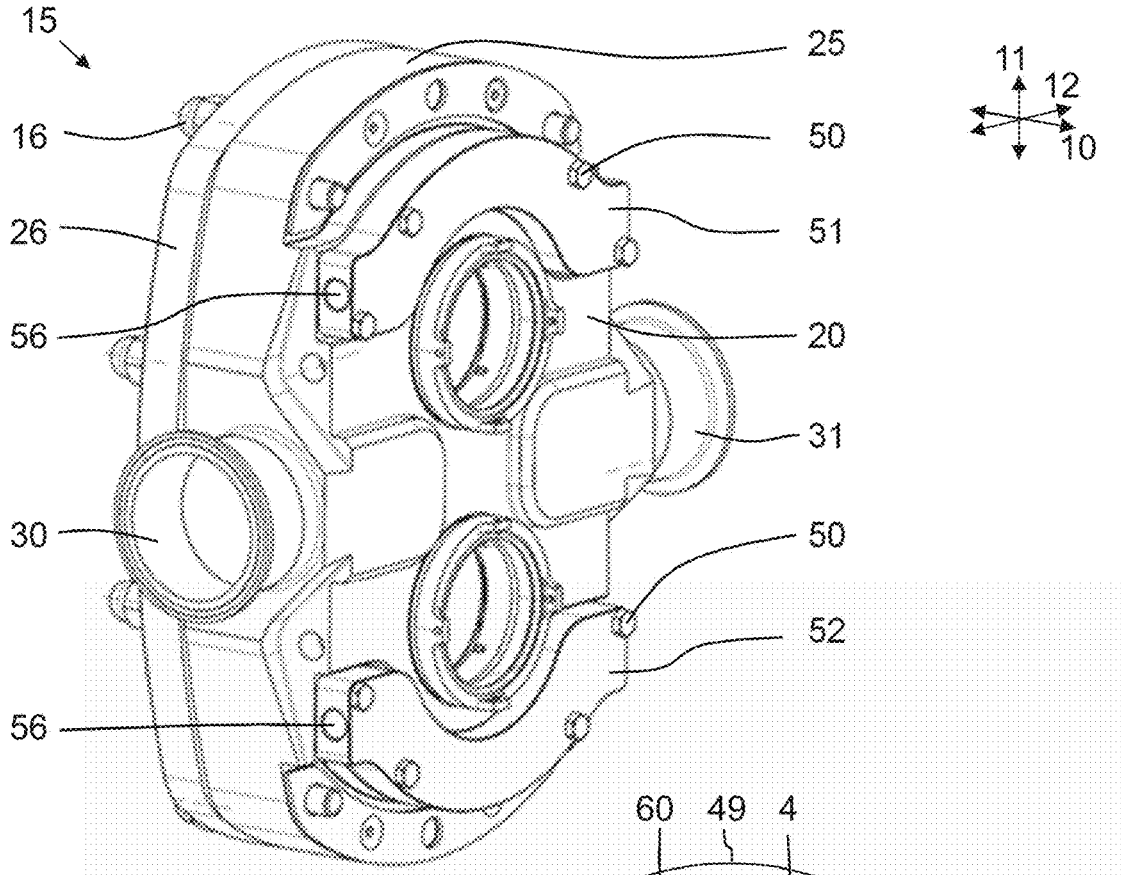
FIG. 8 shows schematically a perspective view of a rotor casing according to an example embodiment of the pump.

FIG. 8 shows a perspective rear-view of the rotor casing 15 with the first and second heating devices 51, 52 fastened to the rear wall 20 of the rotor casing 15 by means of threaded fasteners 50. In particular, each heating device 51, 52 is pressed against the rear wall 20 of the rotor casing 15 by means of threaded fasteners 50 that engage in threaded holes located in the rear wall 20 of the rotor casing 15.

Figure 11:
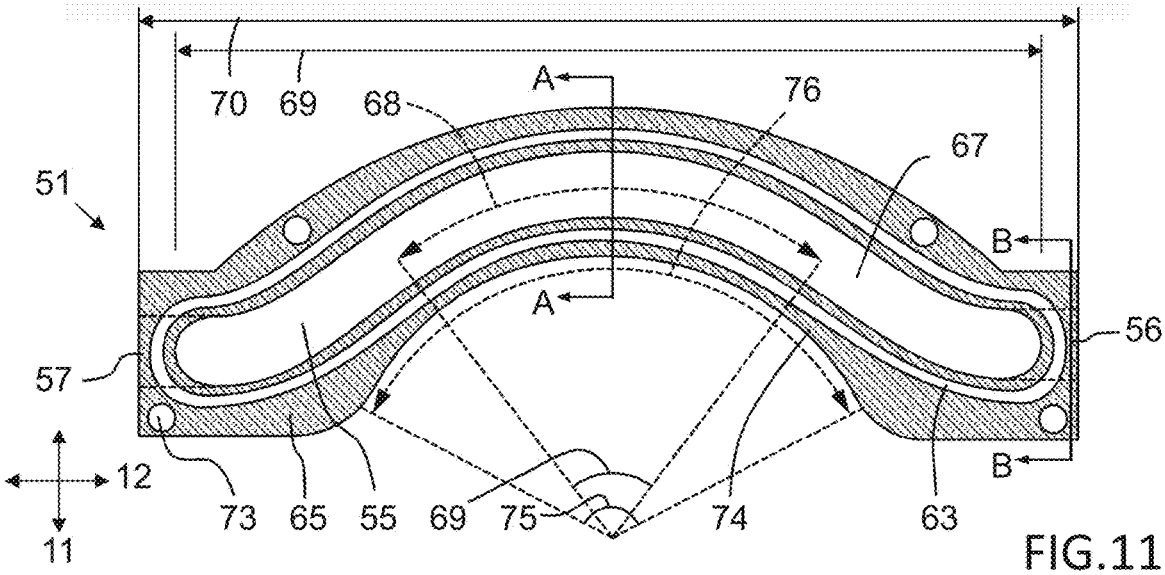
FIG. 11 shows schematically a side-view of a heating device according to an example embodiment of the pump.

The threaded fasteners 50 may for example extend through dedicated attachment holes 73 provided in the heating device 51, 52, as shown in FIG. 11. Alternatively, the heating device 51, 52 may be clamped against the rear wall 20 of the rotor casing by clamping members, such as brackets or the like.

In FIGS. 6, 8-11 and 13-15, the heating device(s) are illustrated in a fluidly disconnected state, i.e. a state in which a fluid inlet and fluid outlet of the heating devices are not connected to a piping arrangement configured for supply and return of heat transfer fluid.

Figure 9:
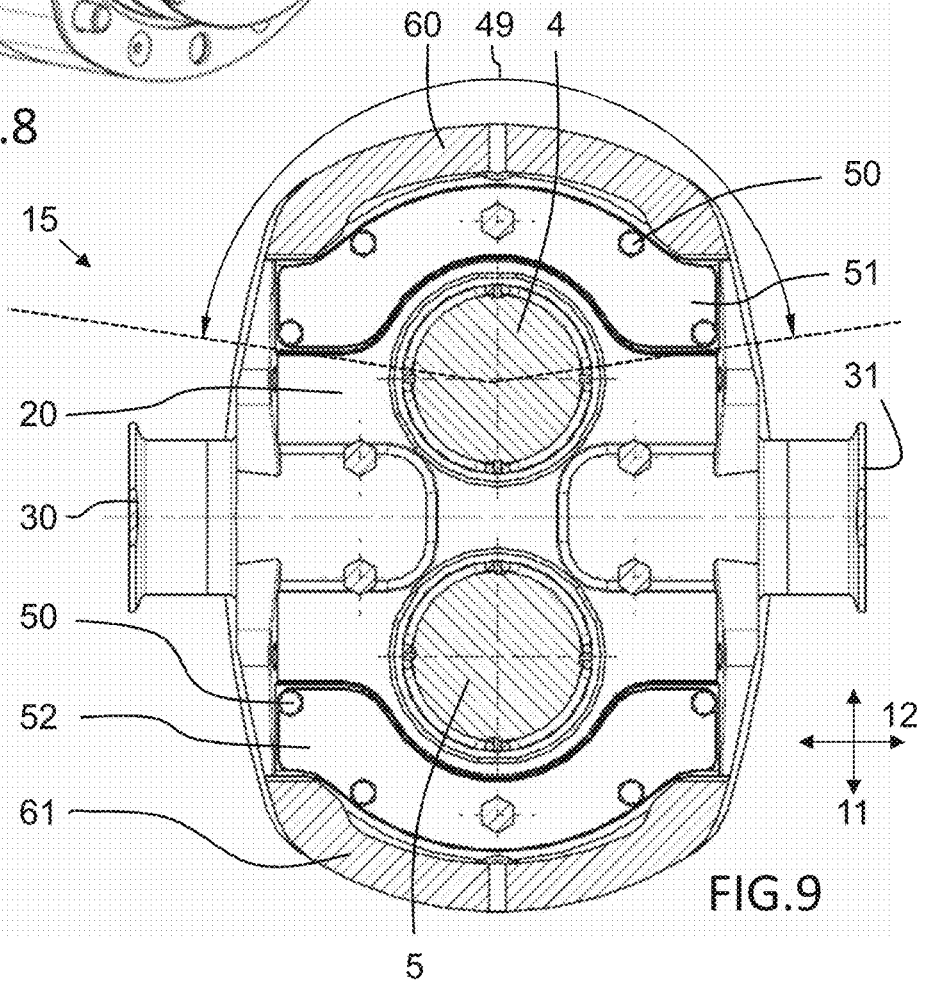
FIG. 9 shows schematically a side-view of a rotor casing according to an example embodiment of the pump.

FIG. 9 shows a rear view of a cross-section of the pump 1 in the region of the intermediate space 42. The layout, size and extension of the first and second heating devices 51, 52 relative to the axial rear wall 20 of the rotor casing 15, as well as the relative location of the first and second heating devices 51, 52 with respect to the first and second drive shafts 4, 5, according to one example embodiment of the pump is clearly shown.

In particular, FIG. 9 shows that a contact surface between the heating device 51, 52 and axial rear wall 20 of the rotor casing 15, as viewed in an axial direction 10 of the pump 1, extends over at least ⅓ of the circumference of the first or second drive shaft 4, 5, i.e. over at least about 120°. More in detail, an angle 49 is illustrated in FIG. 9, which angle indicates the level of contact surface between the heating device 51, 52 and axial rear wall 20 of the rotor casing 15, as viewed in an axial direction 10 of the pump 1. In FIG. 9, the angle is about 160°, but may vary between about 120-360°. 360° means that the contact surface between the heating device 51, 52 and axial rear wall 20 of the rotor casing 15, as viewed in an axial direction 10 of the pump 1, entirely surrounds the first or second drive shaft 4, 5. A large contact surface generally results in increased heating capacity of the heating device 51, 52.

FIGS. 8 and 9 further show that the pump 1 has an axial direction 10 parallel with the first and second drive shafts 4, 5, a first lateral direction 11 extending perpendicular to the axial direction 10 and through rotational centres of the first and second drive shafts 4, 5, and the pump 1 comprises a first heating device 51 arranged on an outer side of the first drive shaft 4, in the first lateral direction 11, and the pump 1 further comprises a second heating device 52 arranged on an outer side of the second drive shaft 5, in the first lateral direction 11. In other words, the first and second heating devices 51, 52 are arranged on opposite outer sides of the first and second drive shafts 4, 5. As a result, the first and second drive shafts 4, 5 are framed by the first and second heating devices 51, 52 along the first lateral direction 11. This position for the first and second heating devices 51, 52 are beneficial because it is located close the first and second sealing arrangements while still having sufficient free space for receiving the first and second heating devices 51, 52.

Figure 10:
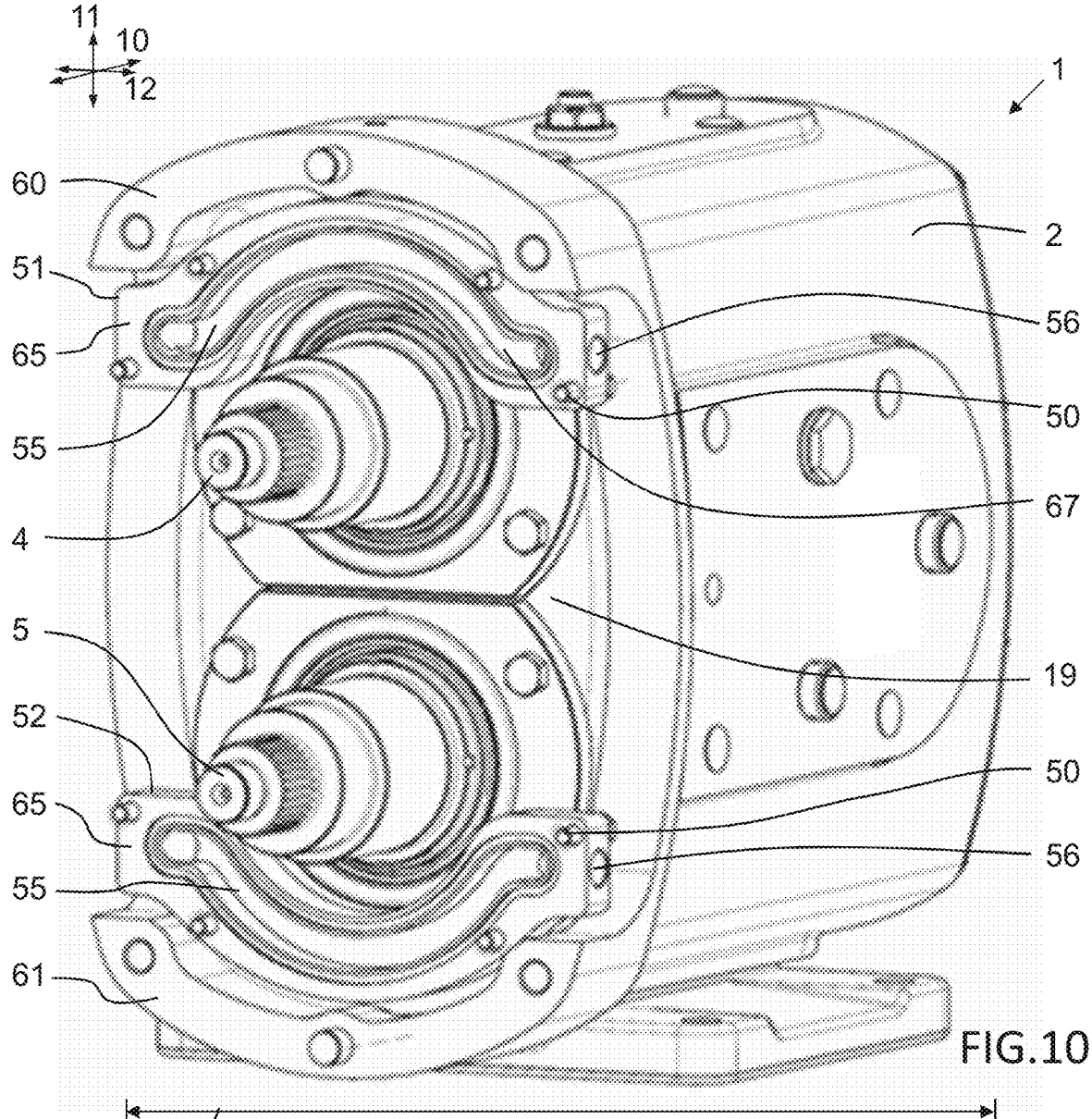
FIG. 10 shows schematically a perspective view of a transmission housing according to an example embodiment of the pump.

FIG. 10 shows a perspective front view of the pump 1 in a partly disassembled state including the transmission housing 2 and the first and second heating devices 51, 52. Consequently, the internal fluid heating chamber 55 that is open towards the axial rear wall 20 of the rotor casing 15 is visible in FIG. 10, as well as the first and second drive shafts 4, 5 protruding forwards from the transmission housing 2.

Moreover, also the first and second axially protruding attachment portions 60, 61 of the transmission housing 2 are clearly illustrated in FIG. 10. The first and second axially protruding attachment portions 60, 61 protrude in the axial direction 10 towards the front side of the pump 1. When the rotor casing is mounted to the axially protruding attachment portions 60, 61, the intermediate space 42 is formed between the rear wall 20 of the rotor casing 15 and a front wall 19 of the transmission housing 2. The heating devices 51, 52 are arranged in said intermediate space 42.

With reference to for example FIGS. 6-10, a further advantageous aspect of the pump according to the present disclosure is that the heating device 51, 52 does not influence the exterior pump dimensions. In other words, the exterior pump dimensions remain the same with or without the heating device 51, 52 fastened to the rotor casing 15. This results from the fact that a total length 70 of the heating casing 51, 52, in a direction perpendicular to an axial direction 10 of the pump 1, is smaller than a total length of the transmission housing 2 and/or the rotor casing 15, when compared in the same direction and in a fastened stated of the heating casing 51, 52.

This enables a more flexible use of the pump 1 because the heating and/or cooling of the rotary casing 25 may be a feature that is added to an already installed pump at a later state if desired, without risk for interfering with neighbouring equipment such as pipes, etc. Moreover, the location of the heating device 51, 52 in the intermediate space 42 provides a more protected location of the heating devices 51, 52, thereby reducing the risk for damages to the heating device 51, 52 and/or leakage of heat transfer fluid.

In fact, a further advantageous aspect of the pump according to the present disclosure is that one heating device 51, 52, or one set of heating devices 51, 52, may be made suitable for installation on a range of different pumps 1. In other words, thanks to the positioning of the first and second heating devices 51, 52 in the intermediate space 42 between the transmission housing 2 and rotor casing 15, a certain size, shape and form of the heating devices 51, 52 may relatively easily be made to fit a plurality of different types of rotor casings 15, because the interface between the heating devices 51, 52 and the rotor casing 15 is typically merely a flat contact surface.

Figure 23:
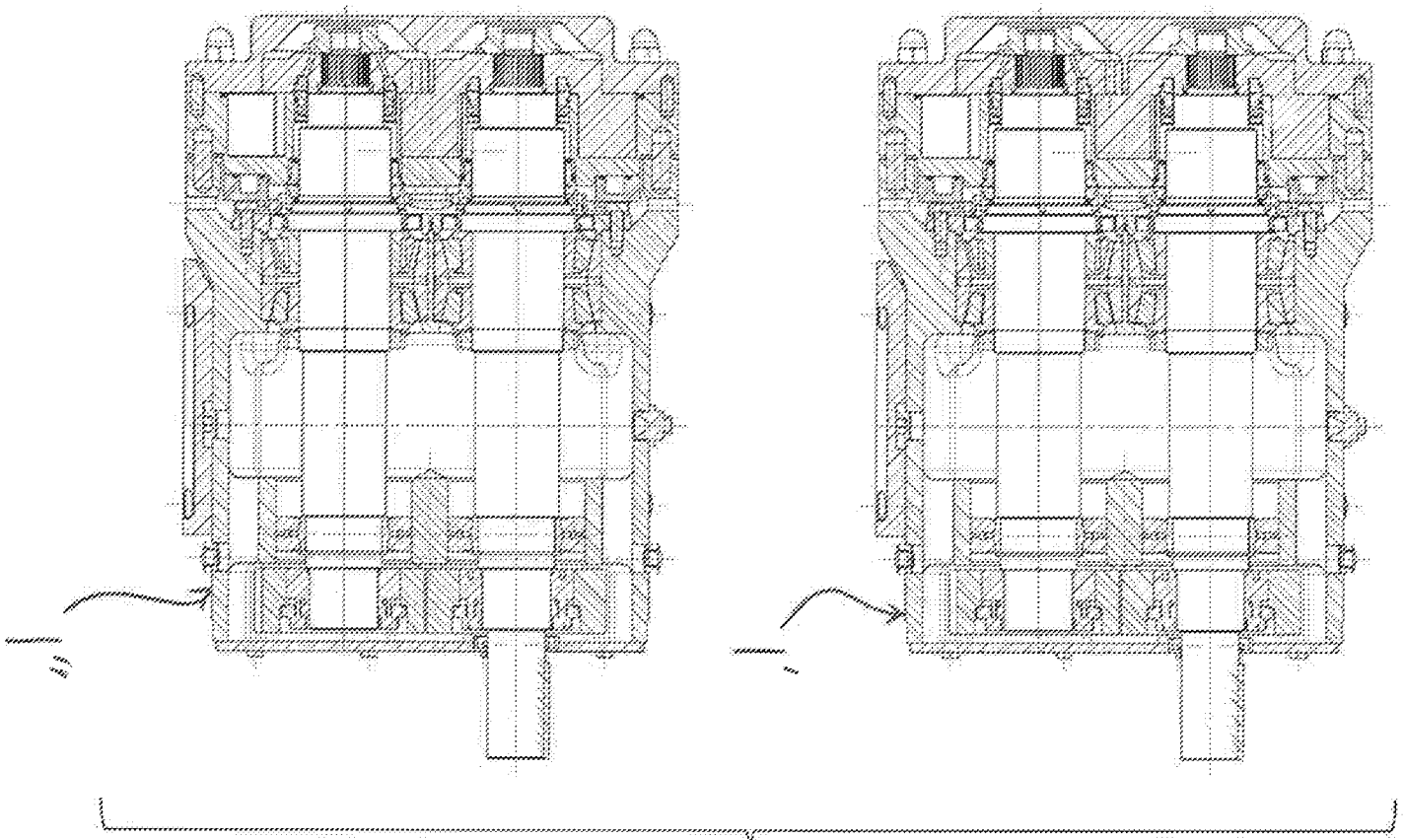
FIG. 23 shows schematically an example of two rotary positive displacement pumps having different displacement volumes per revolution, but both having identical heating devices.

Consequently, according to one aspect of the disclosure, there is provided a set of rotary positive displacement pumps including: a first rotary positive displacement pump as described herein having a first displacement volume per revolution, and a second rotary positive displacement pump as described herein having a second displacement volume per revolution that is larger than the first displacement volume per revolution, wherein both the first and second rotary positive displacement pumps are configured for having identical heating devices 51, 52 fastened to the axial rear wall 20 of the rotor casing 15. An example of this is schematically shown in FIG. 23, which depicts a first rotary positive displacement pump 1' having a first displacement volume per revolution, and a second rotary positive displacement pump 1" having a second displacement volume per revolution that is larger than the first displacement volume per revolution, with both the first and second rotary positive displacement pumps 1', 1" being configured for having identical heating devices.

Specifically, both the first and second rotary positive displacement pumps are configured for having identical heating devices 51, 52 fastened to the axial rear wall 20 of the rotor casing 15 in terms of for example identical sizes, dimensions, attachment holes, sealing arrangements, etc. of the heating devices 51, 52. Thereby, fewer individual parts are required while still enabling the option to supply the pump with heating/cooling.

FIG. 11 schematically shows a front view of a heating device 51 including the internal fluid heating chamber 55 and continuous sealing groove 63 surrounding the opening of the internal fluid heating chamber 55.

Figure 12A:
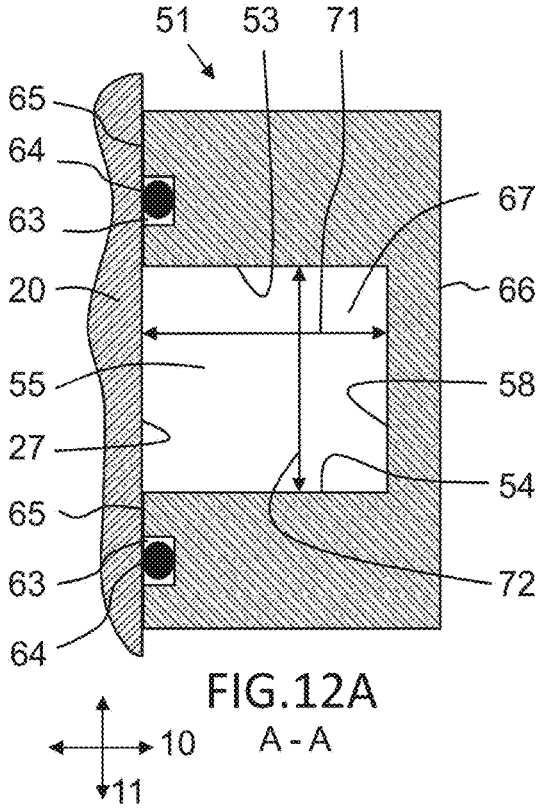
FIG. 12A-12B show schematically cross-sections of the heating device along cut A-A and B-B, respectively.

FIG. 12A shows a cross-section of the heating device 51 along cut A-A in FIG. 11, including a portion of the rear wall 20 of the rotor casing 15. FIG. 12A shows the internal fluid heating chamber 55 that is defined by a bottom wall 58, first and second side walls 53, 54. FIG. 12A also shows the sealing groove 63 and a sealing ring or sealing bead 64 arranged within the sealing groove 63.

Figure 12B:
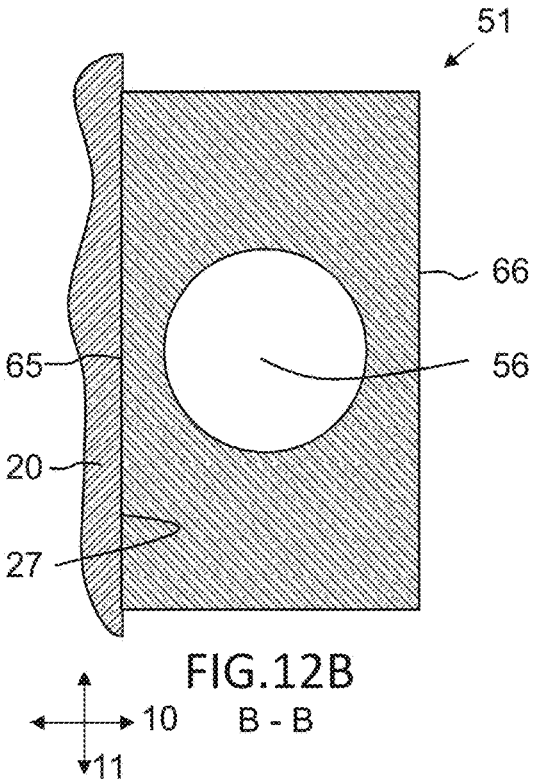

FIG. 12B shows a cross-section along cut B-B in FIG. 11 including a portion of the rear wall 20 of the rotor casing 15. FIG. 12B shows the fluid inlet 56, which is in fluid connection with the internal fluid heating chamber 55 and arranged to be connected with a heat transfer fluid supply pipe.

FIGS. 12A and 12B also show the flat contact surface 65 of the heating device 51, 52 abutting a corresponding flat contact surface 27 of the axial rear wall 20 of the rotor casing 15, and a rear surface 66 of the heating device facing the transmission housing 2. Specifically, the heating device 51, 52 has a flat surface 65 that is pressed against a corresponding flat surface 27 of the rear wall 20 of the rotor casing 15.

With reference in particular to FIGS. 6-12B, the heating device 51, 52 may, as indicated above, correspond to a heating casing having an internal fluid heating chamber 55, a fluid inlet 56 and a fluid outlet 57, wherein the internal fluid heating chamber 55 may be fluidly connected to the fluid inlet 56 and the fluid outlet 57. The heating casing is typically hollow, or includes an open or closed channel 67, for providing the internal fluid heating chamber 55. The heating casing may for example be made of stainless steel, steel, aluminium, or other type of metal material, or even polymeric material.

Moreover, as described with reference to FIGS. 7, 10-11 and 12A, the internal fluid heating chamber 55 may be partly defined by the heating casing 51, 52 and partly by the rear wall 20 of the rotor casing 15.

This scenario occurs for example when the heating casing has an open channel 67, i.e. a channel that at a certain position is open and accessible in a direction perpendicular to a flow direction of the heat transfer fluid at said position, and wherein the open channel is closed by means of the rear wall 20 of the rotor casing 15 upon attachment of the heating casing to the rear wall 20 of the rotor casing 15.

In other words, the internal fluid heating chamber 55 may be deemed being partly limited, restricted or enclosed by the heating casing 51, 52 and partly be the rear wall 20 of the rotor casing 15. As a result, the internal fluid heating chamber 55 may be jointly defined by the interior bottom wall 58 of the channel 67, the first and second interior side walls 53, 54 of the channel 67 and the rear wall 20 of the rotor casing 15. Thereby, the heat transfer fluid may be in direct contact with the surface 27 of the rear wall 20 of the rotor casing for efficient heat transfer capacity.

With reference again to FIGS. 7, 10-11 and 12A, the heating casing 51, 52 may thus have an elongated channel 67 formed in a contact surface 65 of the heating casing 51, 52, wherein the elongated channel 67 faces towards the axial rear wall 20 of the rotor casing 15, and wherein an elongated interior surface 53, 54, 58 of the elongated channel 67 and a surface 27 of the rear wall 20 jointly define the internal fluid heating chamber 55.

The term "elongated" herein means that a length of a portion of the channel 67 in a flow direction of the heat transfer fluid at said portion is significantly larger than an internal width of the channel 67 in a direction perpendicular to the flow direction at said portion.

The elongated channel 67 may be formed in a flat exterior surface 65 of the heating casing 51, 52, and the flat exterior surface 65 surrounding the channel 67 is in contact with and pressed against a corresponding flat surface 27 of the rear wall 20 of the rotor casing 15.

Furthermore, the elongated channel 67 may for example be machined in the flat exterior surface 65 of the heating casing 51, 52 facing the rotor casing 15. Alternatively, the elongated channel 67 may be formed in the flat exterior surface 65 of the heating casing 51, 52 in connection with casting of the heating casing 51, 52.

The channel 67 may follow a curved path from the fluid inlet 56 to the fluid outlet 57, wherein the curved path is curved around the cylindrical outer surface of the first and/or second drive shaft 4, 5. For example, the curved path of the elongated channel 67 may over a certain length 68 of the curvature have a shape of an arc of a circle that is coaxial with the centre of the first or second drive shaft 4, 5. In particular, the elongated channel 67 may have a curvature with the shape of an arc of a circle over an arc angle 69 of at least 25°, specifically at least 45°.

Moreover, the heating device 51, 52 may have a curved exterior surface 74 that bends around and follows at least a portion of the cylindrical outer surface of the first and/or second drive shaft 4, 5. For example, the curved exterior surface may over a certain length 76 of the curvature have a shape of an arc of a circle that is coaxial with the centre of the first or second drive shaft 4, 5. In particular, the curved exterior surface 74 may have a curvature with the shape of an arc of a circle over an arc angle 75 of at least 45°, specifically at least 75°.

The elongated channel 67 may have a length 69 of at least 50%, specifically at least 75%, of a total length 70 of the heating casing 51, 52, in a direction perpendicular to an axial direction 10 of the pump 1. This ensures that heat transfer fluid may be in direct contact with the rear wall 20 of the rotor casing over a relatively large surface area, thereby providing good heating efficiency.

The elongated channel may have a length of about 5-30 cm, wherein a main part of the elongated channel has a depth 71 of at least 5 mm, specifically in the range of 5-30 mm, and a width 72 of at least 5 mm, specifically in the range of about 5-30 mm. In particular, the elongated channel may have a length of about 5-30 cm in a direction perpendicular to an axial direction 10 of the pump 1, wherein a main part of the elongated channel has a depth 71 in the axial direction 10 of at least 5 mm, specifically in the range of 5-30 mm, and a width 72 in a direction perpendicular to a local flow direction of at least 5 mm, specifically in the range of about 5-30 mm.

Furthermore, as mentioned above, the heating casing may have a seal 64 arranged at the flat surface 65 of the heating casing 51, 52 and extending around the channel 67 for preventing leakage of heating fluid at a contact region between the heating casing 51, 52 and rotor casing 15. The seal may for example be an O-ring seal that is arranged in circumferential sealing grove provided in the flat surface 65 of the heating casing 51, 52.

Figure 13:
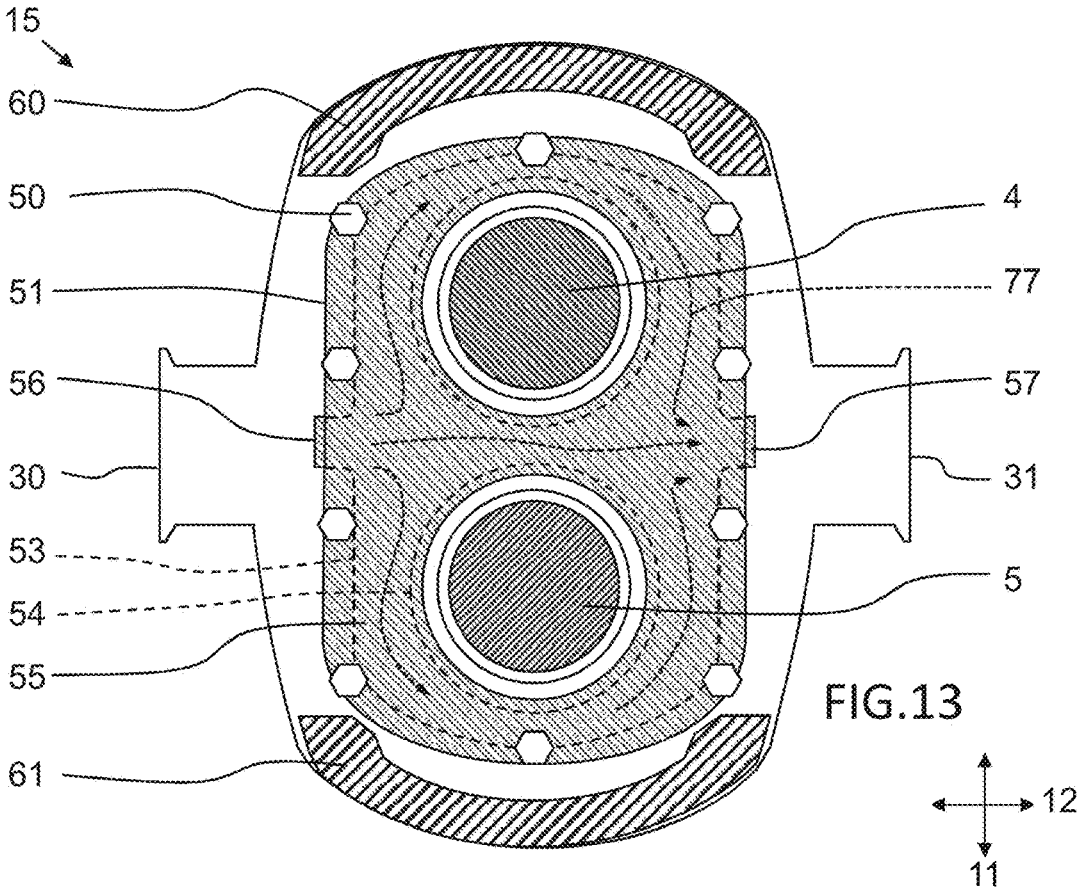
FIG. 13-15 show schematically some alternative designs of the heating device(s) of the pump.

A further example embodiment of the pump 1 is described with reference to FIG. 13, wherein a single heating device 51 completely surrounds both the first and second drive shafts 4, 5, as well as the region of the rear wall 20 located between the first and second drive shafts 4, 5. The single heating device 51 has an internal fluid heating chamber 55 that is fluidly connected to a fluid inlet 56 and a fluid outlet 57 and is defined by first and second side walls 53, 54. The internal fluid heating chamber 55 may extend around both the first and second drive shafts 4, 5, as well as the region located between the first and second drive shafts 4, 5. In other words, heat transfer fluid that is supplied to the fluid inlet 56 may follow a flow path either around the first drive shaft 4, or around the second drive shaft or through the centre region between the first and second drive shafts 4, 5, on the way towards the fluid outlet 57, in indicated by flow arrows 77 in FIG. 13. This example embodiment of the heating casing may provide further increased heating capacity due to the increased contact size.

Figure 14:
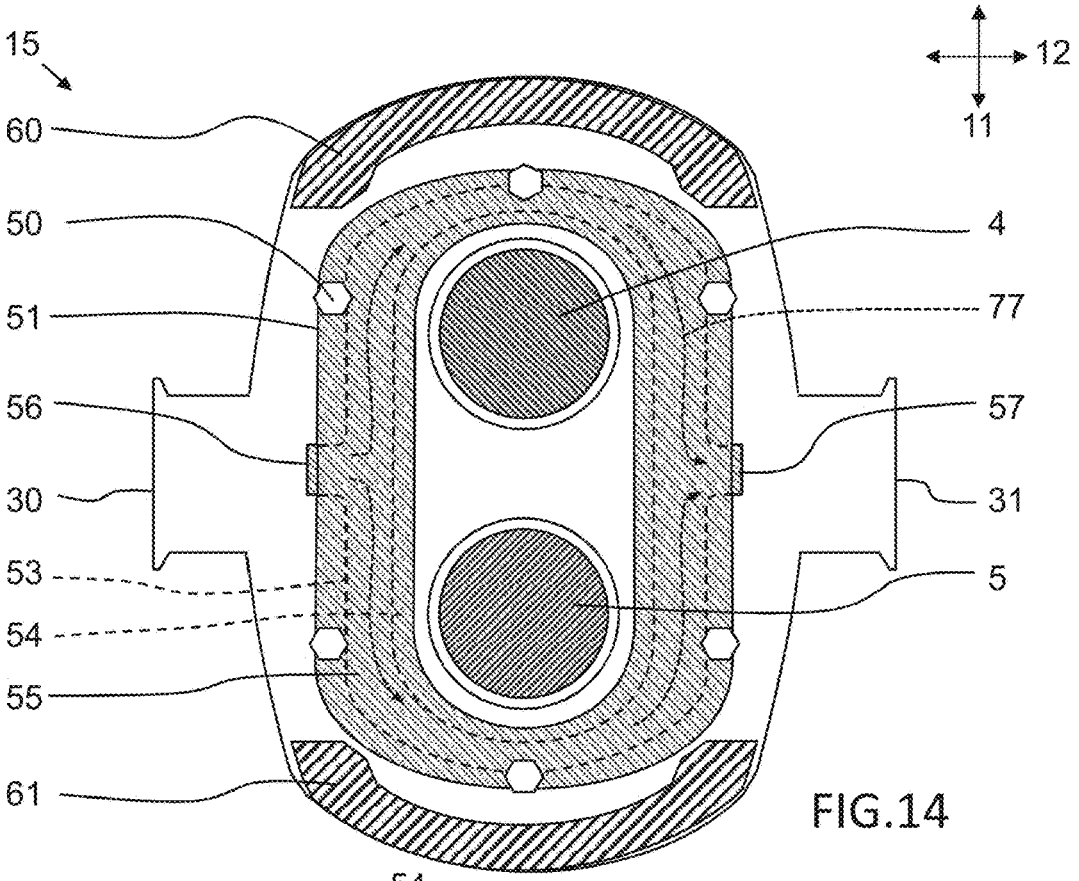

A further example embodiment of the pump 1 is described with reference to FIG. 14, wherein a single heating device 51 completely surrounds the first and second drive shafts 4, 5. The single heating device 51 has an internal fluid heating chamber 55 that is fluidly connected to a fluid inlet 56 and a fluid outlet 57 and is defined by first and second side walls 53, 54. The internal fluid heating chamber 55 may extend around both the first and second drive shafts 4, 5, but not covering the region located between the first and second drive shafts 4, 5. In other words, heat transfer fluid that is supplied to the fluid inlet 56 may follow a flow path either around the first drive shaft 4, or around the second drive shaft 5, on the way towards the fluid outlet 57, in indicated by flow arrows 77 in FIG. 14. This example embodiment of the heating casing may provide further increased heating capacity due to the increased contact size.

Figure 15:
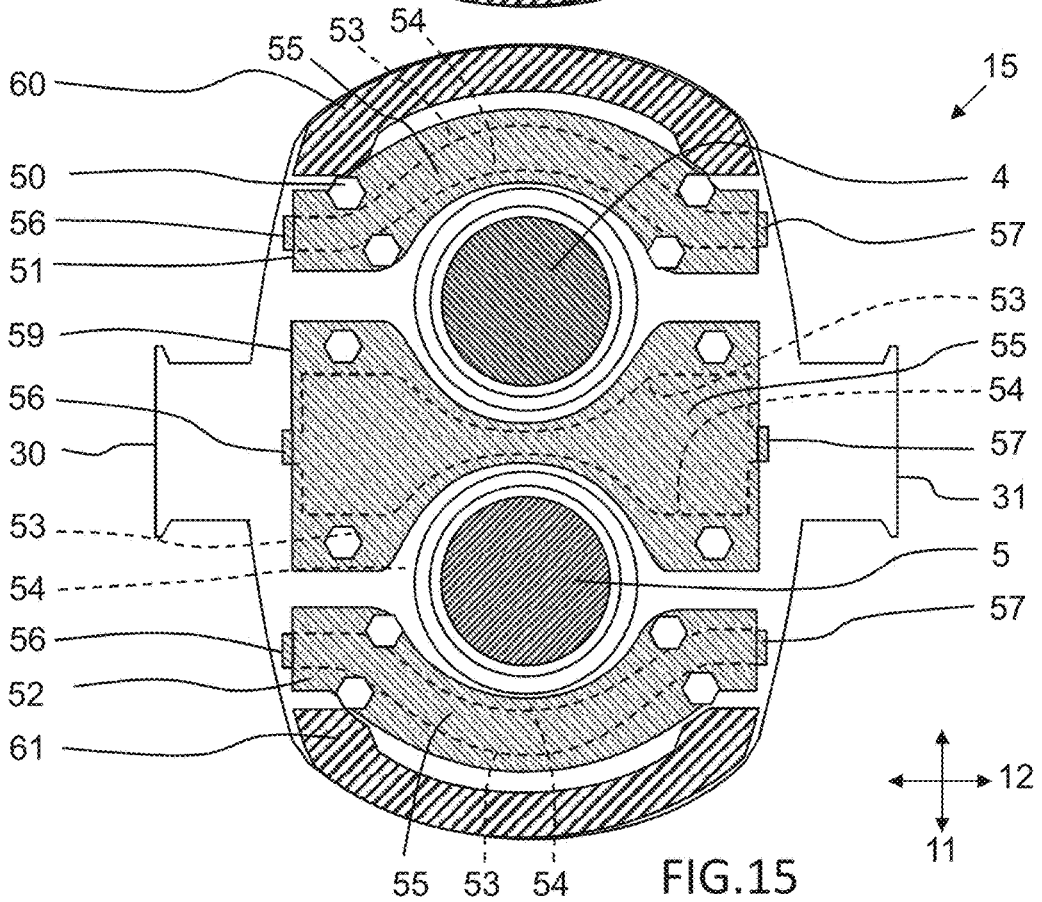

Still a further example embodiment of the pump 1 is described with reference to FIG. 15, wherein three heating devices 51, 52, 59 are provided. The first and second heating devices 51, 52 are arranged on the outer side of the first and second drive shafts 4, 5, respectively, in a fashion similar to that described with reference to FIGS. 8-10, and thus provided with individual internal fluid heating chambers 55, fluid inlets 56 and fluid outlets 57. However, the example embodiment of FIG. 15 differs in that a third heating device 59 is provided in a centre region between the first and second drive shafts 4, 5. The third heating device 59 is also provided with an individual internal fluid heating chamber 55, a fluid inlet 56 and a fluid outlet 57. Each of the first to third heating devices 51, 52, 59 may be completely individual parts with individual fastening devices, thereby enabling independent removal of a single heating device 51, 52 59. This example embodiment of the heating casings may provide improved modular design because some pumps may have all heating devices 51, 52, 59 installed and some pumps may have only some of the heating devices 51, 52, 59 installed.

Figure 16:
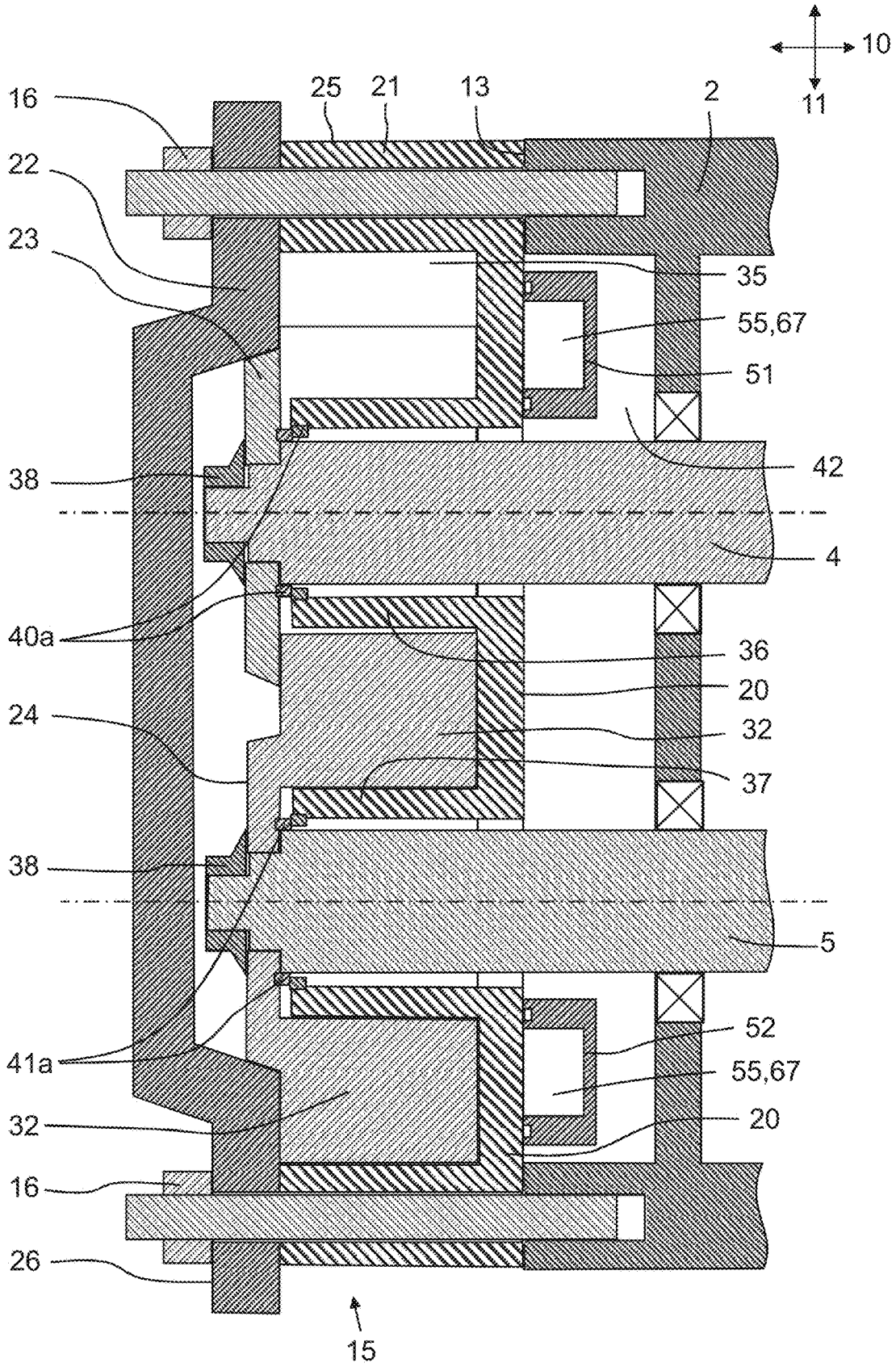
FIG. 16-18 show schematically some alternative designs of the rotor casing of the pump.
Figure 17:
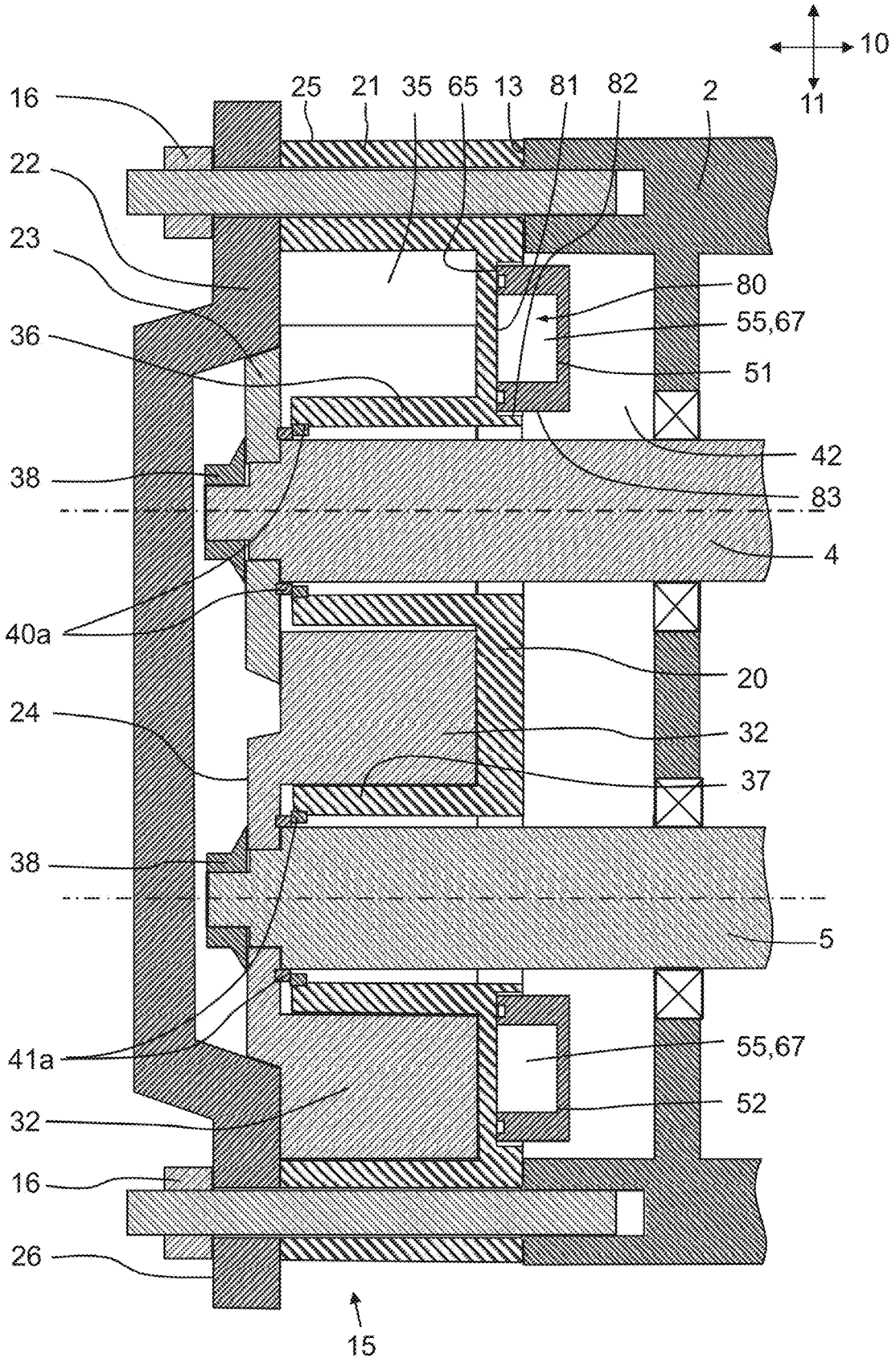
Figure 18:
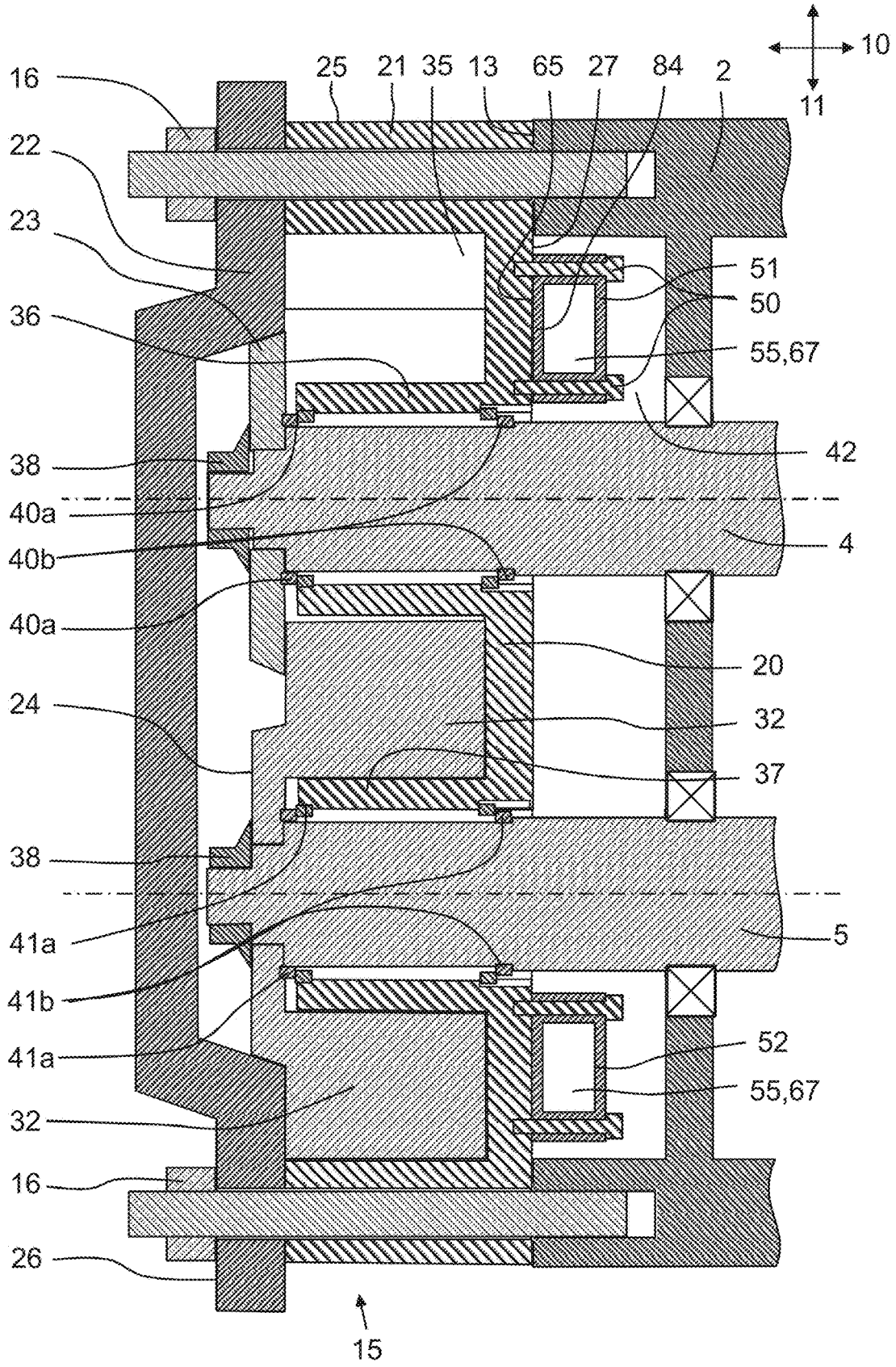

FIGS. 16-18 schematically show some further example embodiments of the pump 1, in particular with respect to the rotor casing design. Most aspect of the general design and functionality of the first and second drive shafts 4, 5, the first and second hubs 36, 37, the first and second rotors 23, 24, first and second sealing arrangements 40*a*, 40*b*, 41*a*, 41*b*, the first and second heating devices 51, 52 and the overall design of the rotor casing 15 are substantially the same as described above with reference to FIGS. 1-12B.

FIGS. 16-18 for example clearly show the positioning of the first and second heating devices 51, 52 in the intermediate space 42 between the transmission housing 2 and the rotor casing 15, as well as the closeness of the first and second heating devices 51, 52 to the first and second sealing arrangements 40*a*, 40*b*, 41*a*, 41*b*.

FIG. 17 shows an example embodiment of the pump 1 where the axial rear wall 20 of the rotor casing 15 has a recess 80 defined by a flat surface 81 perpendicular to an axial direction 10 of the pump 1 and facing towards the rear side of the pump 1, and by a radial surface 82 facing in a direction 11 perpendicular to said axial direction 10, wherein the heating device 51, 52 has a flat surface 65 pressed against the flat surface 81 of the recess 80, and a radial surface 83 facing the radial surface 82 of the recess. The recess 80 may for example be provided by reducing the thickness of the rear wall 20 at the location of the first and second heating devices 51, 52 and enables an even closer positioning of the first and second heating devices 51, 52 to the first and second sealing arrangements 40*a*, 40*b*, 41*a*, 41*b*. Moreover, thanks to the radial surface 83 facing the radial surface 82 of the recess, the first and second heating devices 51, 52 may heat the rear wall 20 not only in the axial direction 10 but also in a radial direction 11, thereby contributing to the further enhances heating efficiency.

FIG. 18 shows an example embodiment where each of the first and second heating devices 51, 52 comprises a closed internal fluid heating chamber 55. The heat transfer fluid does thus not have direct contact with the rear wall 20 of the rotor casing 15, and heat must instead conduct through a side wall 84 of the heating casing 51, 52 before reaching the rear wall 20 of the rotor casing 15. The side wall 84 of the heating casing 51, 52 may preferably have a flat contact surface 65 that is abutting a corresponding flat contact surface 27 of the axial rear wall 20 of the rotor casing 15. The closed internal fluid heating chamber 55 eliminates the risk for leakage of heat transfer that may occur of the internal fluid heating chamber 55 is open towards the rear wall 20.

FIG. 18 also shows how the first and second heating devices 51, 52 may be fastened to the rear wall 20 of the rotor casing 15 by means of threaded fasteners 50 that extend through the first and second heating devices 51, 52 and engage in threaded holes located in the rear wall 20 of the rotor casing 15.

FIGS. 7 and 16-18 also shows that the rotor casing 15 may have a first cylindrical rotor case hub 36 and a second cylindrical rotor case hub 37, each extending from the axial rear wall 20 of the rotor casing 15 towards the front wall 22, wherein the stationary interior pumping cavity is defined by the axial rear wall 20, the circumferential side wall 21, the front wall 22 and the first and second cylindrical rotor case hubs 36, 37. The first cylindrical rotor case hub 36 receives internally therein the first drive shaft 4 and the second cylindrical rotor case hub 37 receives internally therein the second drive shaft 5. The first sealing arrangement 40*a*, 40*b* is located at least partly within an annular space defined by an exterior surface of the first drive shaft 4 and an interior surface of the first hub 36, and the second sealing arrangement 41*a*, 41*b* is located at least partly within an annular space defined by an exterior surface of the second drive shaft 5 and an interior surface of the second hub 37.

Figure 19:
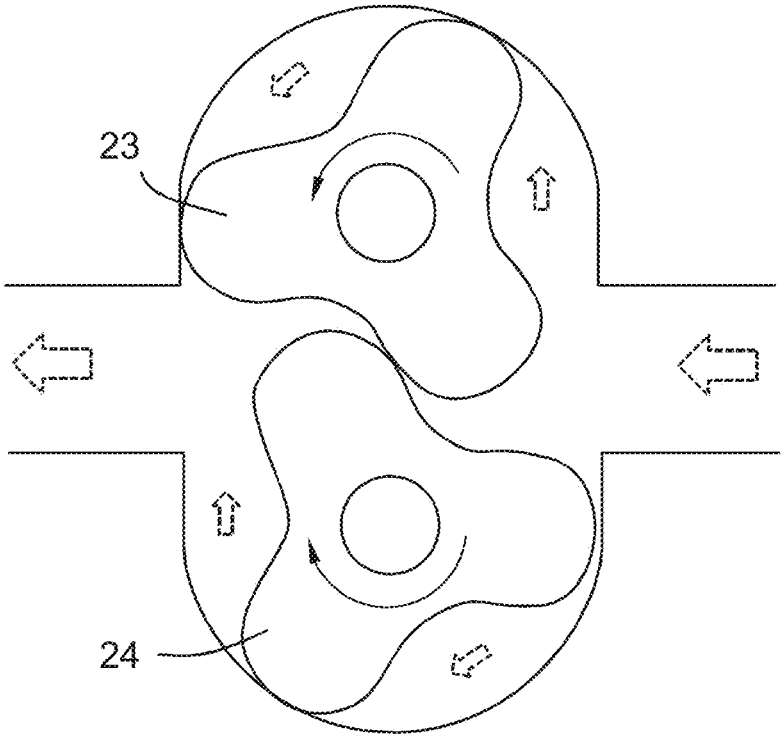
FIG. 19-20 show schematically two alternative designs of the rotors of the pump.
Figure 20:
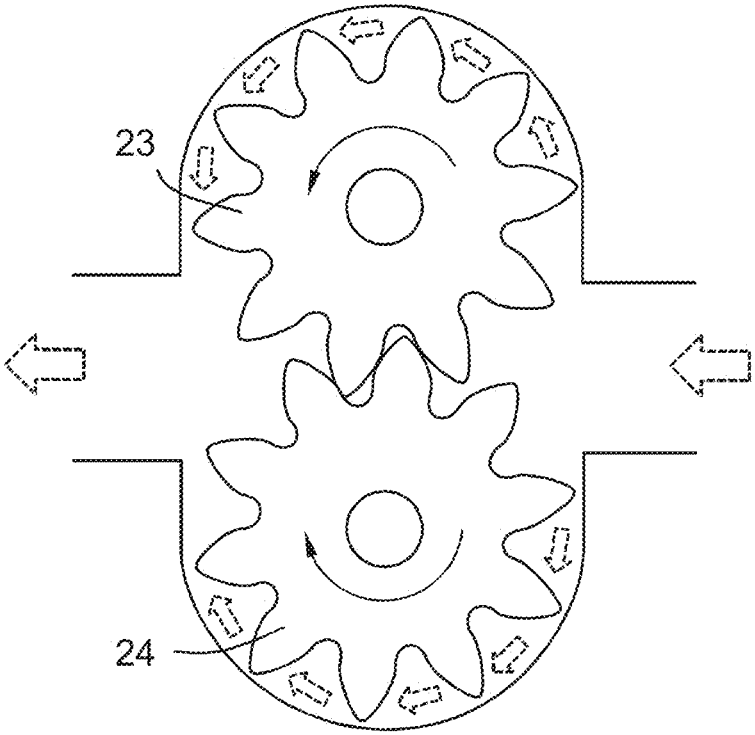

The rotary positive displacement pump according to the present disclosure has primarily been described above in FIGS. 2, 4, 5, 7 and 16-18 with reference to implementation in form of a circumferential piston pump. However, the rotary positive displacement pump according to the present disclosure may alternatively be implemented in form of rotary lobe pump having first and second oppositely rotating rotors 23, 24 configured for mutually interacting for providing a positive pumping effect on a fluid product, as schematically illustrated in FIG. 19, or in form of a gear pump having first and second oppositely rotating rotors 23, 24 configured for mutually interacting for providing a positive pumping effect on a fluid product, as schematically illustrated in FIG. 20.

Figure 21:
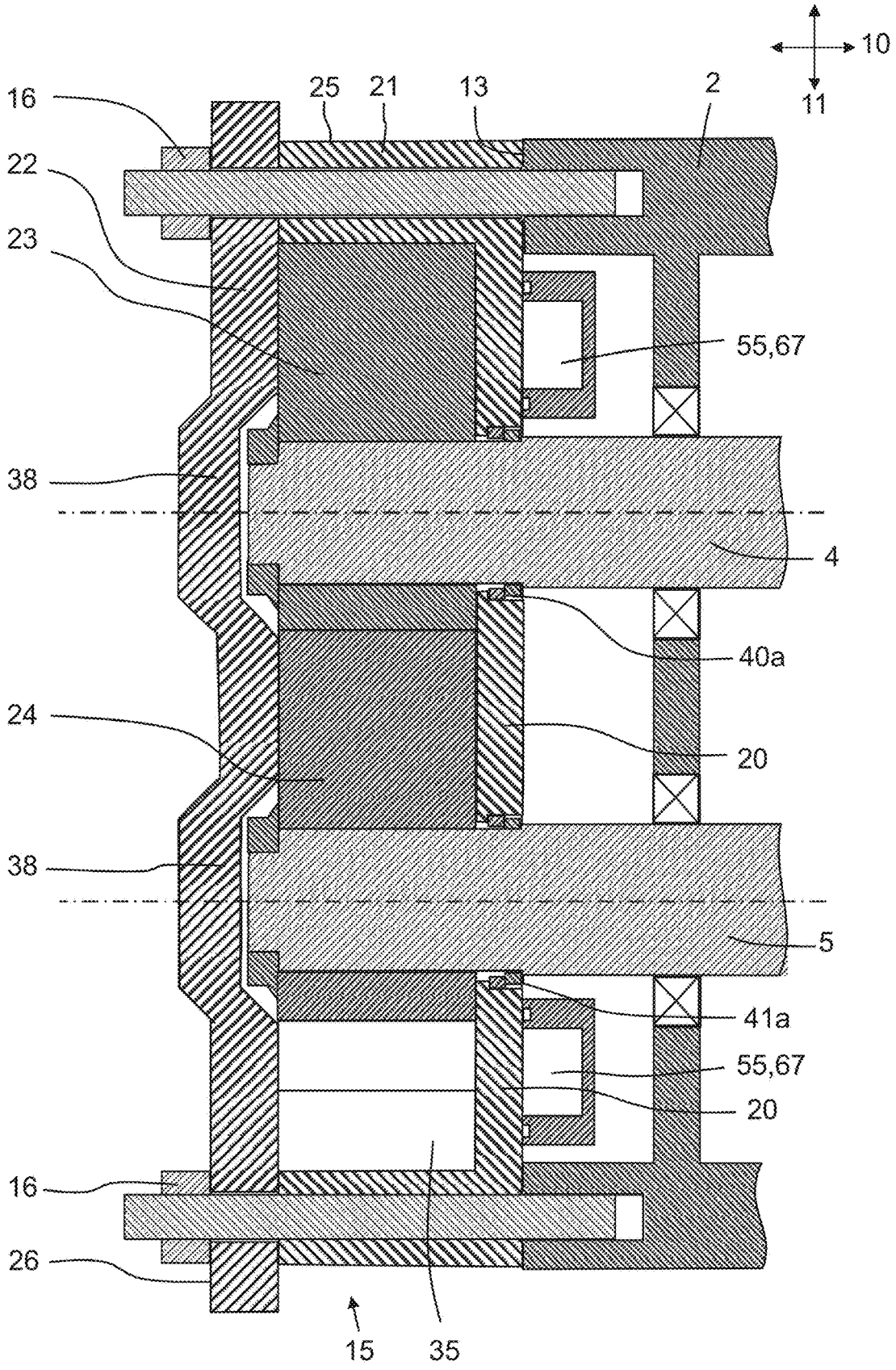
FIG. 21 shows schematically a cross-section of the rotor casing according to another embodiment.

FIG. 21 schematically shows a cross-section of a rotary lobe pump 1 without first and second cylindrical rotor case hubs 36, 37. In such a scenario the first and second sealing arrangements 40*a*, 41*a* may be located between the rear wall 20 of the first and second drive shafts 4, 5, respectively, thereby providing an even closer arrangement of the first and second heating devices 51, 52 to the region of the rotor casing 15 that holds the first and second sealing arrangements 40*a*, 41*a*.

Figure 22:
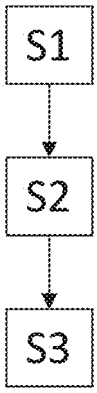
FIG. 22 shows schematically the basic steps of a method for heating a rotor casing and/or a fluid product within the rotor casing of a rotary positive displacement pump.

The present disclosure also relates to a method for heating a rotor casing 15 and/or a fluid product within the rotor casing 15 of a rotary positive displacement pump 1 having a front side and a rear side. The main steps of the method will be described below with reference to FIG. 22. The method may comprise an optional first step S1 of providing a rotary positive displacement pump 1 having a transmission housing 2 and a rotor casing 15, wherein the transmission housing 2 gives rotational support to first and second parallel and axially extending drive shafts 4, 5 having gears 6, 7 in constant mesh condition, such that the first and second drive shafts 4, 5 are arranged to rotate in opposite directions, wherein the rotor casing 15 is connected to a front side 13 of the transmission housing 2 and having an axial rear wall 20, an axial front wall 22 and a circumferential side wall 21 jointly defining a stationary interior pumping cavity, wherein the rotor casing 15 houses a first rotor 23 that is drivingly connected to the first drive shaft 4 and a second rotor 24 that is drivingly connected to the second drive shaft 5, wherein the first and second rotors 23, 24 are configured for rotating in opposite directions and mutually interacting for providing a positive pumping effect on a fluid product that enters the pumping cavity via a rotor casing inlet 30 and exits the pumping cavity via a rotor casing outlet 31, and wherein the rotor casing further includes first and second sealing arrangements 40*a*, 40*b*, 41*a*, 41*b* configured for preventing fluid product from leaking out from the stationary pumping cavity towards the rear side of the rotor casing 15 along the first and second drive shafts 4, 5, respectively. In absence of the first step S1, the rotary positive displacement pump (1) comprises a transmission housing (2) and the rotor casing (15), wherein the transmission housing (2) gives rotational support to first and second parallel and axially extending drive shafts (4, 5) having gears (6, 7) in constant mesh condition, such that the first and second drive shafts (4, 5) are arranged to rotate in opposite directions, wherein the rotor casing (15) is connected to a front side of the transmission housing (2) and having an axial rear wall (20), an axial front wall (22) and a circumferential side wall (21) jointly defining a stationary interior pumping cavity, wherein the rotor casing (15) houses a first rotor (23) that is drivingly connected to the first drive shaft (4) and a second rotor (24) that is drivingly connected to the second drive shaft (5), wherein the first and second rotors (23, 24) are configured for rotating in opposite directions and mutually interacting for providing a positive pumping effect on a fluid product that enters the pumping cavity via a rotor casing inlet (30) and exits the pumping cavity via a rotor casing outlet (31), wherein the rotor casing (15) further includes first and second sealing arrangements (40*a*, 40*b*, 41*a*, 41*b*) configured for preventing fluid product from leaking out from the stationary pumping cavity towards the rear side of the rotor casing (15) along the first and second shafts (4, 5), respectively.

The method comprises a second step S2 of detachably fastening a heating device 51, 52 to the axial rear wall 20 of the rotor casing 15.

Finally, the method comprises a third step S3 of activating the heating device 51, 52 for heating the rotor casing 15 in a region close to the first and second sealing arrangements 40*a*, 40*b*, 41*a*, 41*b* and/or any fluid product within rotor casing 15.

The term "activating" herein means for example powering an electrical heating device 51, 52, or providing a flow of warm heating fluid through the heating device 51, 52.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, modifications may be made to adapt a particular situation or material to the teachings of the present disclosure without departing from the essential scope thereof.

Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims. Reference signs mentioned in the claims should not be seen as limiting the extent of the matter protected by the claims, and their sole function is to make claims easier to understand.

The invention claimed is:

1. A rotary positive displacement pump for pumping a fluid product, the pump having a front side and a rear side and comprising:

a transmission housing providing rotational support to first and second parallel and axially extending drive shafts having gears in constant mesh condition, such that the first and second drive shafts are arranged to rotate in opposite directions, a rotor casing connected to a front side of the transmission housing and having an axial rear wall, an axial front wall and a circumferential side wall jointly defining a stationary interior pumping cavity, wherein the rotor casing houses a first rotor that is drivingly connected to the first drive shaft and a second rotor that is drivingly connected to the second drive shaft, wherein the first and second rotors are configured for rotating in opposite directions and mutually interacting for providing a positive pumping effect on the fluid product that enters the pumping cavity via a rotor casing inlet and exits the pumping cavity via a rotor casing outlet, wherein the rotor casing further includes first and second sealing arrangements configured for preventing the fluid product from leaking out from the stationary pumping cavity towards the rear side of the rotor casing along the first and second drive shafts, respectively, wherein the pump further comprises a heating device configured for heating the rotor casing, the first and second sealing arrangements and/or any fluid product within the rotor casing, the heating device being separate from both the transmission housing and the rotor casing, the heating device being detachably fastened to the axial rear wall of the rotor casing so that the heating device is separable from the rotor casing.

2. The rotary positive displacement pump according to claim 1, wherein the heating device is reattachable to the axial rear wall of the rotor casing.

3. The rotary positive displacement pump according to claim 1, wherein the heating device is detachably fastened to the axial rear wall of the rotor casing by means of releasing fasteners.

4. The rotary positive displacement pump according to claim 1, wherein the heating device is a heating casing having an internal fluid heating chamber, a fluid inlet and a fluid outlet, and wherein the internal fluid heating chamber is fluidly connected to the fluid inlet and the fluid outlet.

5. The rotary positive displacement pump according to claim 4, wherein the internal fluid heating chamber is partly defined by the heating casing and partly be the axial rear wall of the rotor casing.

6. The rotary positive displacement pump according to claim 4, wherein the heating casing has an elongated channel formed in a surface of the heating casing, wherein the elongated channel faces towards the axial rear wall of the rotor casing, and wherein an elongated interior surface of the elongated channel and a surface of the axial rear wall jointly define the internal fluid heating chamber.

7. The rotary positive displacement pump according to claim 6, wherein the first drive shaft and the second drive shaft each have a cylindrical outer surface, the elongated channel following a curved path from the fluid inlet to the fluid outlet, wherein the curved path is curved around the cylindrical outer surface of the first and/or second drive shaft.

8. The rotary positive displacement pump according to claim 6, wherein surface of the heating casing in which the elongated channel is formed is a flat surface, the heating casing having a seal arranged at the flat surface of the heating casing and extending around the elongated channel for preventing leakage of heating fluid at a contact region between the heating casing and the rotor casing.

9. The rotary positive displacement pump according to claim 1, wherein the heating device has a flat surface that is pressed against a corresponding flat surface of the axial rear wall of the rotor casing.

10. The rotary positive displacement pump according to claim 1, wherein the heating device is pressed against the axial rear wall of the rotor casing by means of threaded fasteners that engage in threaded holes located in the axial rear wall of the rotor casing.

11. The rotary positive displacement pump according to claim 1, wherein the first drive shaft and the second drive shaft each have a cylindrical outer surface, the heating device having a curved surface that bends around and follows at least a portion of the cylindrical outer surface of the first and/or second drive shaft.

12. The rotary positive displacement pump according to claim 1, wherein the pump has an axial direction parallel with the first and second drive shafts, a first lateral direction extending perpendicular to the axial direction and through rotational centres of the first and second drive shafts, wherein the pump comprises a first heating device arranged on an outer side of the first drive shaft, in the first lateral direction, and wherein the pump comprises a second heating device arranged on an outer side of the second drive shaft, in the first lateral direction.

13. The rotary positive displacement pump according to claim 1, wherein the heating device does not influence exterior dimensions of the rotary positive displacement pump.

14. The rotary positive displacement pump according to claim 1, wherein the axial rear wall of the rotor casing has a recess defined by a flat surface perpendicular to an axial direction of the pump and facing towards the rear side of the pump, and by a radial surface facing in a direction perpendicular to said axial direction, wherein the heating device has a flat surface pressed against the flat surface of the recess and a radial surface facing the radial surface of the recess.

15. The rotary positive displacement pump according to claim 1, wherein the rotor casing has a first cylindrical rotor case hub and a second cylindrical rotor case hub, each extending from the axial rear wall of the rotor casing, wherein the stationary interior pumping cavity is defined by the axial rear wall, the circumferential side wall, the axial front wall and the first and second cylindrical rotor case hubs, wherein the first cylindrical rotor case hub receives internally therein the first drive shaft and the second cylindrical rotor case hub receives internally therein the second drive shaft, wherein the first sealing arrangement is located at least partly within an annular space defined by an exterior surface of the first drive shaft and an interior surface of the first hub, and wherein the second sealing arrangement is located at least partly within an annular space defined by an exterior surface of the second drive shaft and an interior surface of the second hub.

16. A set of rotary positive displacement pumps including:

first and second rotary positive displacement pumps each according to claim 1, the first rotary positive displacement pump having a first displacement volume per revolution and the second rotary positive displacement pump having a second displacement volume per revolution that is larger than the first displacement volume per revolution, wherein both the first and second rotary positive displacement pumps are configured for having identical heating devices fastened to the axial rear wall of the rotor casings.

17. The set of rotary positive displacement pumps according to claim 16, wherein the identical heating devices fastened to the axial rear wall of the rotor casings include: i) a first heat device separate from both the transmission housing and the rotor casing of the first rotary positive displacement pump and detachably fastened to the axial rear wall of the rotor casing of the first rotary positive displacement pump so that the first heating device is separable from the rotor casing of the first rotary positive displacement pump; and ii) a second heat device separate from both the transmission housing and the rotor casing of the second rotary positive displacement pump and detachably fastened to the axial rear wall of the rotor casing of the second rotary positive displacement pump so that the second heating device is separable from the rotor casing of the second rotary positive displacement pump.

18. The rotary positive displacement pump according to claim 1, wherein the heating device is attachable to the axial rear wall of the rotor casing, detachable from the axial rear wall of the rotor casing and reattachable to the axial rear wall of the rotor casing.

19. A method for heating a rotor casing and/or a fluid product within the rotor casing of a rotary positive displacement pump having a front side and a rear side, wherein the rotary positive displacement pump comprises a transmission housing and the rotor casing, wherein the transmission housing gives rotational support to first and second parallel and axially extending drive shafts having gears in constant mesh condition, such that the first and second drive shafts are arranged to rotate in opposite directions, wherein the rotor casing is connected to a front side of the transmission housing and having an axial rear wall, an axial front wall and a circumferential side wall jointly defining a stationary interior pumping cavity, wherein the rotor casing houses a first rotor that is drivingly connected to the first drive shaft and a second rotor that is drivingly connected to the second drive shaft, wherein the first and second rotors are configured for rotating in opposite directions and mutually interacting for providing a positive pumping effect on a fluid product that enters the pumping cavity via a rotor casing inlet and exits the pumping cavity via a rotor casing outlet, wherein the rotor casing further includes first and second sealing arrangements configured for preventing fluid product from leaking out from the stationary pumping cavity towards the rear side of the rotor casing along the first and second shafts, respectively, the method comprising:

detachably fastening a heating device to the axial rear wall of the rotor casing, the heating device being separate from both the transmission housing and the rotor casing, the heating device being detachably fastened to the axial rear wall of the rotor casing so that the heating device is separable from the rotor casing, and activating the heating device for heating the rotor casing, the first and second sealing arrangements and/or any fluid product within the rotor casing.

20. A rotary positive displacement pump for pumping a fluid product, the pump having a front side and a rear side and comprising:

a transmission housing providing rotational support to first and second parallel and axially extending drive shafts having gears in constant mesh condition, such that the first and second drive shafts are arranged to rotate in opposite directions, the transmission housing having an axial front wall;

a rotor casing connected to a front side of the transmission housing and having an axial rear wall, an axial front wall and a circumferential side wall jointly defining a stationary interior pumping cavity;

the rotor casing housing a first rotor that is drivingly connected to the first drive shaft and a second rotor that is drivingly connected to the second drive shaft;

the first and second rotors being configured for rotating in opposite directions and mutually interacting for providing a positive pumping effect on a fluid product that enters the pumping cavity via a rotor casing inlet and exits the pumping cavity via a rotor casing outlet;

the rotor casing including first and second sealing arrangements configured for preventing fluid product from leaking out from the pumping cavity towards the rear side of the rotor casing along the first and second drive shafts, respectively;

the axial rear wall of the rotor casing and the axial front wall of the transmission housing facing one another and being spaced apart from one another by virtue of an axially protruding portion that extends between the rotor casing and the transmission housing;

an intermediate space bounded by the axial rear wall of the rotor casing and the axial front wall of the transmission housing that are spaced apart from one another and by the axially protruding portion; and a heating device configured to heat the rotor casing, the first and second sealing arrangements and/or any of the fluid product within the rotor casing, the heating device being separate from both the rotor casing and the transmission housing, being positioned in the intermediate space and being detachably fastened to the axial rear wall of the rotor casing.

21. The rotary positive displacement pump according to claim 14, wherein the axially protruding portion is a part of the transmission housing, the axially protruding portion projecting towards the rotor casing and having an end surface in contact with the axial rear wall of the rotor casing.

22. The rotary positive displacement pump according to claim 20, wherein the rotor casing is connected to the front side of the transmission housing by a fastener, a part of the fastener being positioned in the axially protruding portion.

23. A rotary positive displacement pump for pumping a fluid product, the pump having a front side and a rear side and comprising:

a transmission housing providing rotational support to first and second parallel and axially extending drive shafts having gears in constant mesh condition, such that the first and second drive shafts are arranged to rotate in opposite directions, the transmission housing having an axial front wall;

a rotor casing connected to a front side of the transmission housing and having an axial rear wall, an axial front wall and a circumferential side wall jointly defining a stationary interior pumping cavity;

the rotor casing housing a first rotor that is drivingly connected to the first drive shaft and a second rotor that is drivingly connected to the second drive shaft;

the first and second rotors being configured for rotating in opposite directions and mutually interacting for providing a positive pumping effect on the fluid product that enters the pumping cavity via a rotor casing inlet and exits the pumping cavity via a rotor casing outlet;

the rotor casing further including first and second sealing arrangements configured for preventing the fluid product from leaking out from the pumping cavity towards the rear side of the rotor casing along the first and second drive shafts, respectively;

the axial rear wall of the rotor casing having an axial rear wall surface that faces towards the axial front wall of the transmission housing; and a heating device configured to heat the rotor casing, the first and second sealing arrangements and/or any of the fluid product within the rotor casing, the heating device comprising a heating casing that is separate from both the rotor casing and the transmission housing, the heating casing being provided with a channel and being detachably fastened to the axial rear wall surface of the rotor casing.

24. The rotary positive displacement pump according to claim 23, wherein the channel is open on one side of the heating casing, the one side of the heating casing being in contact with the axial rear wall surface of the rotor casing.

25. The rotary positive displacement pump according to claim 24, wherein the axial rear wall surface of the rotor casing to which the heating casing is detachably fastened is a flat axial rear wall surface that the heating casing is in contact with.

26. The rotary positive displacement pump according to claim 23, wherein the heating casing includes a fluid inlet and a fluid outlet that both communicate with the channel.

* * * * *